US011011877B2

(12) United States Patent
Sandel

(10) Patent No.: US 11,011,877 B2
(45) Date of Patent: May 18, 2021

(54) TAMPER RESISTANT POWER RECEPTACLE

(71) Applicant: Vernon R. Sandel, Licking, MO (US)

(72) Inventor: Vernon R. Sandel, Licking, MO (US)

( * ) Notice: Subject to any disclaimer, the term of this patent is extended or adjusted under 35 U.S.C. 154(b) by 76 days.

(21) Appl. No.: 15/063,453

(22) Filed: Mar. 7, 2016

(65) Prior Publication Data

US 2016/0261078 A1 Sep. 8, 2016

Related U.S. Application Data

(60) Provisional application No. 62/128,868, filed on Mar. 5, 2015.

(51) Int. Cl.
*H01R 13/71* (2006.01)
*H01R 13/44* (2006.01)
*H01R 24/78* (2011.01)

(52) U.S. Cl.
CPC ..... *H01R 13/71* (2013.01); *H01R 13/44* (2013.01); *H01R 24/78* (2013.01)

(58) Field of Classification Search
CPC ..... H01R 13/71; H01R 13/44; H01R 24/38; H01R 13/20; H01R 13/3172; H01R 24/78
See application file for complete search history.

(56) References Cited

U.S. PATENT DOCUMENTS 2,500,474 A 3/1950 Sperrazza
2,527,382 A 10/1950 Whitlock
2,885,341 A 1/1954 Wilson
3,039,073 A 6/1962 Walker
3,699,285 A 10/1972 Leatherman
3,795,188 A 3/1974 Giani
4,136,919 A * 1/1979 Howard ..... H01R 13/20 439/346
4,168,104 A 9/1979 Buschow
4,271,337 A 6/1981 Barkas
4,530,556 A 7/1985 Bonus
4,544,219 A 10/1985 Barkas
4,586,770 A 5/1986 Poulin
4,607,136 A 8/1986 Thomas
4,722,693 A 2/1988 Rose
4,784,611 A 11/1988 Poulin
4,867,694 A 9/1989 Short
4,932,886 A 6/1990 Glaser
5,286,312 A 2/1994 Shimotsusa
5,320,545 A * 6/1994 Brothers ..... H01R 13/7036 200/51.09

(Continued)

*Primary Examiner* — Briggitte R. Hammond
(74) *Attorney, Agent, or Firm* — Keith D. Grzelak; Wells St. John P.S.

(57) ABSTRACT

The present invention provides safety power outlets having the form and size to fit standard electrical boxes. The present invention includes one or more switched sockets which are generally switched on by movement from a first position to a second position. The described movement is prevented by one or more locks configured to be unlocked by complete insertion of a plug's power blades into the socket. In addition, blade locks are provided to prevent removal of the plug once the movement from the first position to the second position has begun. The movements described herein are both linear and rotary. Embodiments adapted for use with an extension cord socket are also presented.

17 Claims, 15 Drawing Sheets

(56) References Cited

U.S. PATENT DOCUMENTS 5,374,199 A * 12/1994 Chung ..... H01R 13/7036 200/51.09
5,484,299 A * 1/1996 Schlessinger ..... H01R 13/4532 200/51.1
5,692,921 A 12/1997 Jennings
5,915,981 A 6/1999 Mehta
6,050,837 A 4/2000 Duhe
6,079,995 A * 6/2000 Duhe, Jr. ..... H01R 13/652 200/51.09
6,111,210 A * 8/2000 Allison ..... H01R 13/7036 200/51.09
6,749,449 B2 * 6/2004 Mortun ..... H01R 13/703 200/51.09
6,981,888 B2 1/2006 O'Keefe
7,101,215 B2 9/2006 Woellner
7,104,818 B1 9/2006 Chang
7,172,451 B1 2/2007 Ratzlaff
7,455,538 B2 11/2008 Germain
7,537,468 B1 * 5/2009 Huang ..... H01R 13/4536 439/135
7,695,293 B1 * 4/2010 Sikes ..... H01R 13/4532 439/139
7,722,389 B2 * 5/2010 Benoit ..... H01R 13/4534 439/143
7,820,909 B2 * 10/2010 Castaldo ..... H01R 13/4534 174/53
7,887,349 B1 2/2011 Macomber
7,931,482 B2 * 4/2011 Liao ..... H01R 13/44 439/137
8,152,554 B2 4/2012 Chapel
8,193,445 B2 6/2012 Li
8,435,055 B1 * 5/2013 Bhosale ..... H01R 13/4534 439/145
8,545,251 B2 10/2013 Gordon
8,926,350 B2 1/2015 Wolfe
2003/0207606 A1 * 11/2003 Ho ..... H01R 13/20 439/346
2005/0002137 A1 * 1/2005 Germain ..... H01H 83/04 361/42
2007/0229202 A1 * 10/2007 Gao ..... H01H 9/161 335/18
2013/0309883 A1 * 11/2013 Wolfe ..... H01R 13/58 439/106
2014/0213093 A1 * 7/2014 Tal ..... H01R 13/20 439/352
2016/0261078 A1 * 9/2016 Sandel ..... H01R 13/71

* cited by examiner

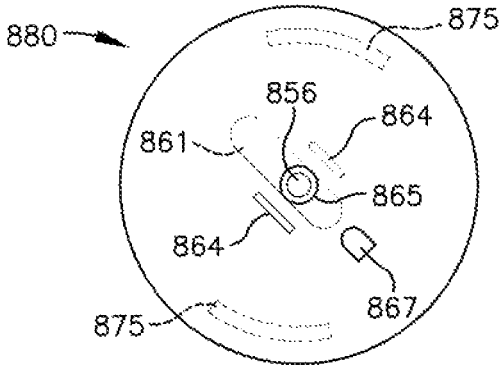
Fig. 57
Fig. 58
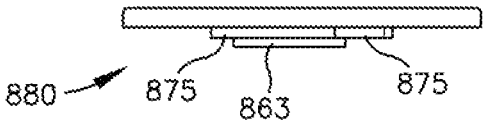
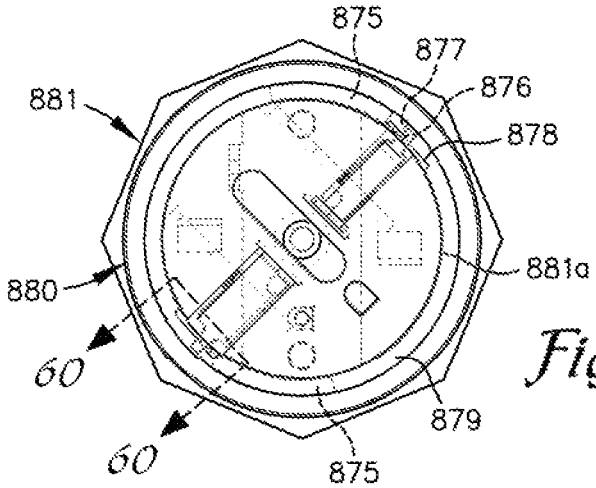
Fig. 59
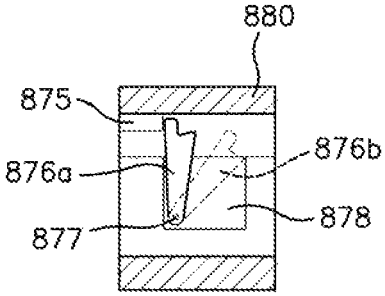
Fig. 60
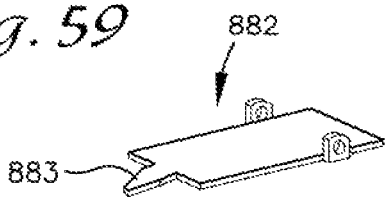
Fig. 61
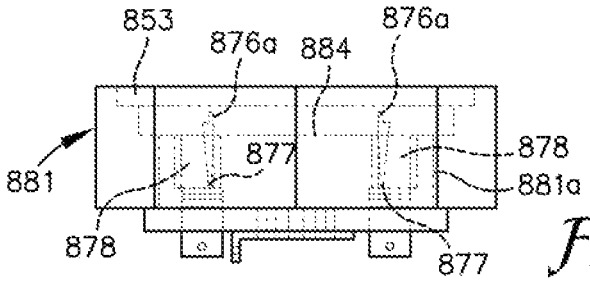
Fig. 62

TAMPER RESISTANT POWER RECEPTACLE

CROSS-REFERENCE TO RELATED APPLICATIONS

The application claims the benefit of the prior filed U.S. provisional application No. 62/128,868 filed on Mar. 5, 2015 which is incorporated herein by reference.

FIELD OF THE INVENTION

The present invention is broadly directed to power outlets and, more particularly, to an improved safety power outlet which has a child-proof, tamper resistant features.

BACKGROUND OF THE INVENTION

An inexpensive, convenient and easy to manufacture safety electrical power receptacle has long been sought to protect children. These have taken the form of devices which block the access slots for the plug blades or switched outlets wherein the contacts in the electrically active slots are not connected to power until a plug is inserted. Since 2008 the National Electrical Code has required tamper resistant (child resistant) power receptacles in all new residential construction and renovation. One type of commonly available commercial products that meet these code requirements uses tamper resistant receptacles with shutters over the two power blade slots which open when the two ramped shutters are pressed aside simultaneously as with the two power blades of a plug. While this is an improvement over the prior art, these are easily defeated and present other disadvantages. For example, the shuttered slot design requires care in inserting a plug into the socket because the two plug blades have to touch the two shutters at exactly the same time; otherwise the plug may be rejected. This can be more challenging when a receptacle is not at eye level or when a receptacle is behind furniture or in other encumbered, hard to reach locations. Additionally, these shuttered receptacles safety features can be defeated by using two objects to open the shutters or by a paper clip bent in the shape of a "U". Obviously, therefore, safety receptacles which receive a plug as easily as the prior non-tamper resistant standard receptacles and which have safety features which are harder to defeat are desirable.

The prior art contains a number of switched receptacles, the switches being operated either by the plug blades themselves, or more commonly by either a rotation or linear motion. Those operated by the plug blades involve a plurality of contacts which are closed by the insertion of the male plug blades. This type of switch is prone to arcing if the device being powered is already switched on when inserting or pulling the plug, and eventually leads to fusion of the contacts and loss of the safety features. The movement switched receptacles can use a more robust type of switch.

U.S. Pat. No. 3,775,726 is an example of a safety receptacle of non-standard form or size but which includes a number of safety elements including: spring biased blocks that prevent a lateral motion until the power prongs of a plug push them out of the path of two "L" shaped prongs designed to penetrate the holes in the blades of standard plugs to retain the plug, and a switch that is turned on at the end of the lateral travel. This solution is similar to the shuttered receptacles, being easily defeated by inserting two thin foreign objects or a "U" shaped wire such as one bent from a paperclip. It would not interfere with the locking blades if inserted at either end of the plug blade slots, and thus would not block the lateral motion to power the socket.

U.S. Pat. No. 4,832,886 describes a sliding socket in which movement toward the rear wall urges a bendable articulated arm carrying a pin through the power blade holes to retain a plug while switching power to blade contacts within the socket. The depressed condition is retained by a push to slide-push to release mechanism similar to a ball point pen. If the socket face is pushed without a plug, the arm blocks access to the powered blade contacts in the socket. It appears that the safety features can be easily defeated by inserting a thin object such as a needle or wire which would not block the plug blade holes into the socket and depressing the socket with a finger. This design also has non-standard size and form.

U.S. Pat. No. 5,286,213 describes a receptacle and an extension cord outlet which secure an inserted plug and powers it by twisting the plug and socket relative to the receptacle body. During the twisting movement, an internal ramp presses nubs against blade receiving contacts putting pressure on the broad sides of the power blades to fix the blades in the socket as an electrical connection to the power supply takes place. The nubs may hold small bumps or pins that engage the holes in the plug power blades to increase the holding power. There is no lock to prevent unwanted movement to the powered state.

U.S. Pat. No. 5,795,168 describes a receptacle of standard size and form in which a plug is inserted, pushed inward against a spring bias, rotated to a stop and is powered when the spring is allowed to push the socket outward to powering contacts. During the rotation a central actuator urges spring mounted pins into plug blade holes to retain the plug, but if rotation occurs without a plug in the socket the actuator also urges a shutter over the socket's plug blade contact. Since both the shutters and pins are on resilient membranes, it appears that sticking a foreign object into the socket before rotating, pushing it inward, rotating the socket and releasing would power the foreign object. A finger nail file or a paper clip would defeat the safety features. Also, if the socket were rotated to the powered position a needle, knife blade, or other pointed object could push the shutter aside, thus reaching the powered hot terminal.

U.S. Pat. No. 8,926,350 uses the same sequence of steps as U.S. Pat. No. 5,795,168 to power a plug inserted into a socket. In the twisting operation a ramp urges a pin through holes in the socket's plug receiving contacts to lock the plug in the socket. This design suffers from the same safety deficiency as the similar design except for the fact that the twist may be stopped if the foreign object does not allow the pin to complete its travel through the holes in the socket's plug receiving contacts. A plug is not needed to push the socket inward as a finger would work equally well. There is no significant resistance to the twisting action as it is only the compression of the return springs of the locking pins in the ramp. Therefore, pressing the socket with the fingers and using the finger nails or a foreign object to rotate the socket would result in an unsafe powered socket.

It would therefore be beneficial to have a rotary or linearly switched safety receptacles which move from an unpowered condition or state to a powered condition or state upon receive a plug and returns to the unpowered position upon removal of the plug while preventing shocks and injury from the insertion of foreign objects. The safety receptacle should also accept a plug as easily as the non-tamper resistant receptacles. This invention addresses all of these objectives.

SUMMARY OF THE INVENTION

The current invention presents switched outlets that power an inserted plug when the socket is moved from a first position to a second position. This movement could be either linear or rotational, and the examples will use both a linear movement toward the rear of the receptacle identical to the usual action when inserting a plug and a rotational movement Blade locks lock the plug power blades of an inserted plug into the socket and the movements terminate with the turning on of a switch, thus powering the plug. The blade locks retain the plug in the socket until the switch is turned off, so that it cannot be removed when in the powered condition. Movement locks in the power blade slots of the sockets may be used to prevent movement of the sockets from the first position to the second position unless the two electrically active blades of a plug are fully inserted.

It is the object of this invention to provide the following: 1) Tamper resistant receptacles that are very hard to defeat. 2) Tamper resistant receptacles that accept a plug as easily as the former non-safety standard receptacles. 3) Tamper resistant receptacles which fit the standard electrical boxes and have shape and form factors that are essentially the same as the formerly used non-tamper resistant power receptacles. 4) Tamper resistant receptacles that eliminate possible dangers from plugs only partially inserted or pulled out, having partially exposed blades. 5) Tamper resistant receptacles that can be easily and inexpensively manufactured. 6) Tamper resistant receptacles which work with all standard plugs, whether they are of the two or three prong variety, polarized or not, or whether they have holes in the blades or not.

Various objects and advantages of the present invention will become apparent from the following description taken in conjunction with the accompanying drawings wherein are set forth, by way of illustration and example, certain embodiments of this invention. The drawings submitted herewith constitute a part of this specification, include exemplary embodiments of the present invention, and illustrate various objects and features thereof.

BRIEF DESCRIPTION OF THE DRAWINGS

FIG. 57 is a top plan view of the top cap of a second embodiment of the extension cord receptacle.

FIG. 58 is a side elevation of the top cap of FIG. 57.

FIG. 59 is a top plan view of the body of the second embodiment of the extension cord receptacle with socket assembly installed.

FIG. 60 is a magnified cross-sectional view of FIG. 59 across the line 60-60.

FIG. 61 is a side perspective view of the plug locking bar used in the second embodiment of the extension cord receptacle.

FIG. 62 is a side plan view of the body of the second embodiment of the extension cord receptacle.

DETAILED DESCRIPTION OF THE INVENTION

Figure 1:
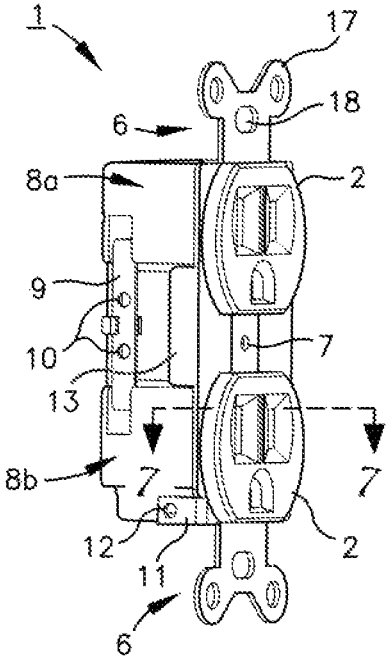
FIG. 1 is a side perspective view of a tamper resistant power receptacle consistent with the first four exemplary embodiments of the present invention since the differences are not visible in this view.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings, the reference numeral 1 generally designates the first four sliding socket exemplary embodiments of the improved tamper resistant power receptacle adapted for movement between a neutral and an energized state having differences that are not visible in this representation.

FIG. 1 shows the external features of the first four exemplary embodiments of the tamper resistant power receptacle 1. The arrow 7'-7' identifies the direction of observance in the cross-sectional views of FIGS. 7, 8, 19, and 25. The receptacle 1 is substantially the same size and shape as the commonly used receptacles for receipt within a standard outlet enclosure or junction box (not shown).

The receptacle 1 has a body 8 that supports a pair of power busses 9 on opposite sides having threaded holes 10 for wire connection, a metal mounting frame 6 with plaster ears 17, mounting openings 18, a threaded cover plate mounting hole 7, and an outwardly extending appendage 11 with threaded opening 12 for ground wire connection. The top cap 2 has the usual slots 3-5 for the hot, neutral, and ground blades respectively for receipt of a common three prong plug (not shown). The body 8 supports a pair of power buses 9 located on opposite sides of the receptacle 1, each with two threaded bus holes 10 for connecting to power supply wires (not shown).

Figure 2:
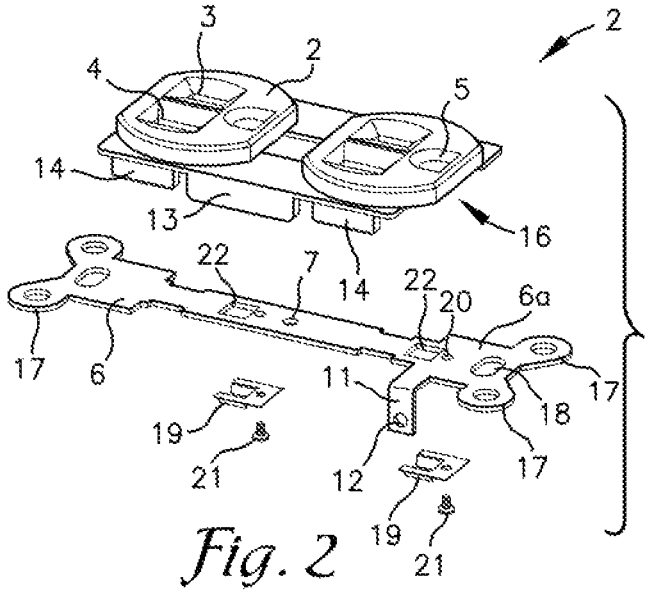
FIG. 2 is an exploded side elevation view of the upper portion of the tamper resistant power receptacle of FIG. 1 showing parts common to the first four exemplary embodiments of the receptacles represented by FIG. 1.

FIG. 2 depicts items common to the first three exemplary embodiments represented by FIG. 1, but not the fourth.

The top cap 2 has the usual slots 3-5 for the blades of a three prong plug, four tabs 14 which are adapted for receipt within body recesses 15 (FIG. 3), two external tabs 13 adapted to span between an upper and lower body regions 8*a*, 8*b* as illustrated in FIG. 1. A shaped recess 16 extends upwardly from the underside of top cap 2 providing for horizontal receipt of the mounting frame 6 while supported above the body 8 in the assembled receptacle. The shaped recess 16 has sufficient dimension offering a rectangular opening between the two socket faces exposing the threaded opening 7 in the mounting frame 6 for attaching a face plate (not shown). When assembled to the body 8 the top cap 2 may be mechanically or chemically secured.

As further depicted in FIG. 2, the illustrated embodiment of the mounting frame 6 includes a pair of rectangular openings 22 for ground contacts 19 which are mechanically fastened with a rivet or threaded fastener through holes 20.

Figure 3:
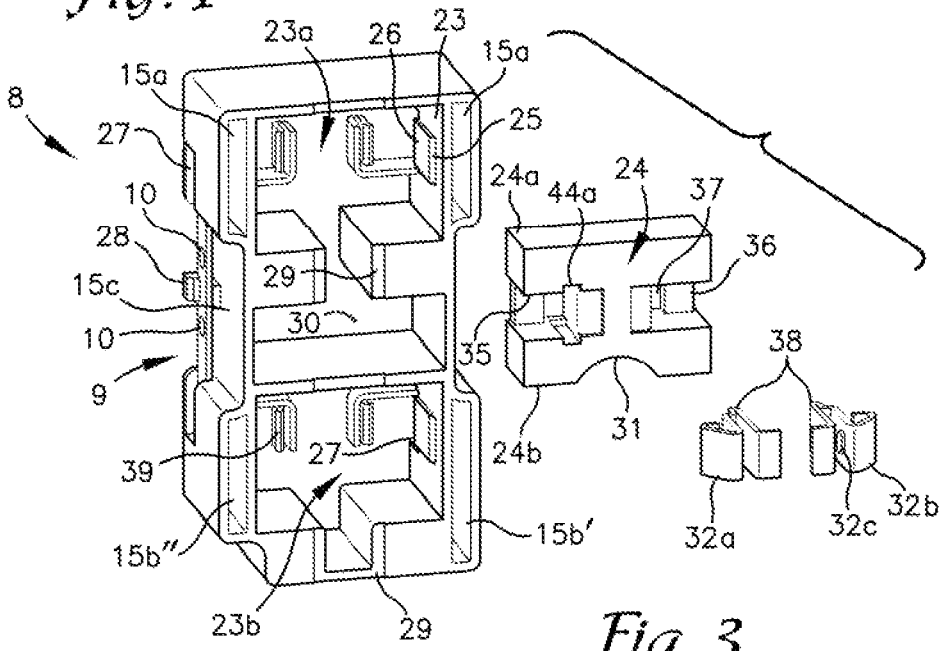
FIG. 3 is a front perspective view of the parts comprising the lower portion of the first exemplary embodiment of the tamper resistant power receptacle of FIG. 1, including a body, a sliding socket, and blade contacts.

FIG. 3 shows the general shape of the parts in the lower portion of the first exemplary embodiment, body assembly 8 which includes the power busses 9 with switch receivers 39 on the ends, sliding socket base 24, and plug blade contacts 32*a* and 32*b*. The body 8 includes four rectangular cavities, two of equal size 15*a* and two of unequal size 15*b*' and 15" adapted to receive the four tabs 14 on the top cap 2. Along each longitudinal side of the body 8, a spanning depression 15*c* extends from the upper cavities 15*a* to the lower cavities 15*b*' and 15*b*", being adapted for receipt of the external tabs 13 of the top cap 2. Internally, the body has upper and lower rectangular cavities 23*a* and 23*b* in which assembled sliding sockets 70 (FIG. 6) will be installed.

A short ramp 25 extends inwardly at an angle from each sidewall of the cavities 23*a* and 23*b*, terminating in a ramp extension 26 which runs parallel to the side wall. Each cavity 23 includes two rectangular channels 27 extending beneath the ramp extension 26 from opposite sides, allowing entrance of switch receivers 39 on the ends of the power busses 9 there through. Each power bus 9 is secured to the body 8 with, for example, external clips 28 located along the side of the body 8 and may be fixed in position with adhesive. A central compartment 30 is positioned below and in communication with the first rectangular receiver 23*a*. Generally, the central compartment allows for the addition of other functionality such as ground fault interruption.

The sliding socket assembly 70 is adapted for receipt within the rectangular cavities 23*a* and 23*b* and is assembled by inserting blade contacts 32*a* or 32*b* into the socket base 24 as shown in FIGS. 3-6. This socket base 24 has planar members 24*a* and 24*b* sized to fit the long sides of the rectangular cavities 23*a* and 23*b*. The planar member 24*b* which is in two sections, includes an arcuate cutout 31 centrally located between the sections. This cutout allows for passage of a ground blade when a three prong plug is inserted into the assembled sliding socket. The longitudinal recesses 35 are shaped to receive blade contacts, or plug blade receivers 32.

Additionally the recesses 35 may have floors 36 which are inset for secure receipt by the ramp extension 26 when the assembled sliding socket 70 is installed in a rectangular cavity 23*a* or 23*b*. As shown in FIG. 3 the two floors also have rectangular passages 37 through which the lower portion of the blade contacts pass, becoming a switch tab 38. One of the recesses 35 has a slot 44*a* which is wider than the blade contacts 32. This is to accommodate the wider plug blade of a polarized plug (not shown).

Figure 4:
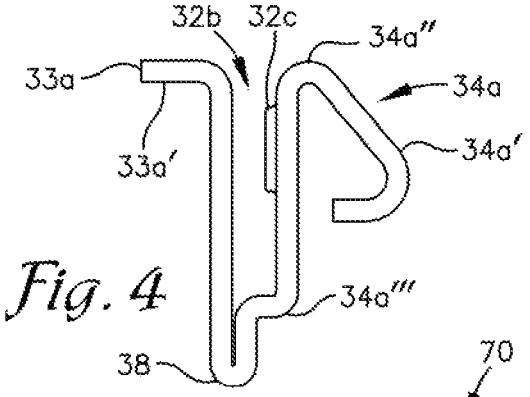
FIG. 4 is a side elevation view of a first embodiment of the blade contact.
Figure 5:
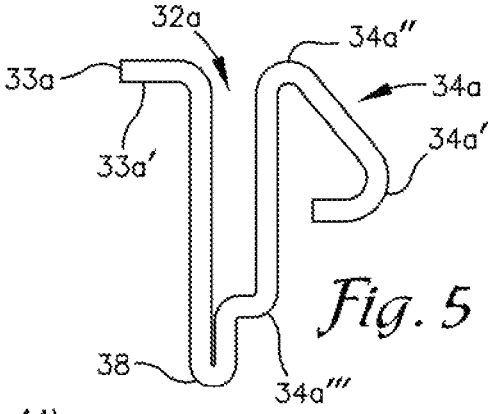
FIG. 5 is side elevation view of a second embodiment of the blade contact.

The blade contacts 32*a* and 32*b* are shown in greater detail in FIGS. 4 and 5. Either type may be used with the first three tamper resistant power receptacles represented by FIG. 1. They are identical in shape except 32*b* has a circular protrusion 32*c* adapted to fit into the hole that most plug power blades have, whereas 32*a* does not. Each of them have first and second sidewall member 33*a* and 34*a* spaced apart appropriately to allow a plug power blade (not shown) to easily pass between them.

As shown in FIG. 4, the first side of a blade contact 33*a* has a substantially horizontal section 33*a*' which sits on a shelf of the sliding socket base 24, extends downward along the rectangular recess 35 of the socket base 24, passing through the rectangular passage 37, whereupon it returns upon itself, forming a switch tab 38 which is adapted to have a friction fit in switch receivers 39 on the power busses 9 in FIG. 3. The proper space between the two sidewall sections 32*a* and 24*a* is set by a horizontal section 34''' which should be substantially equal to the width of a plug power blade. The second sidewall member 34*a* presents crest 34*a*'' and an angularly dependent lip 34*a*' which extends horizontally beyond the socket base member 36 and is designed to sit atop the short ramp 25 in the body 8 of FIG. 3.

Figure 6:
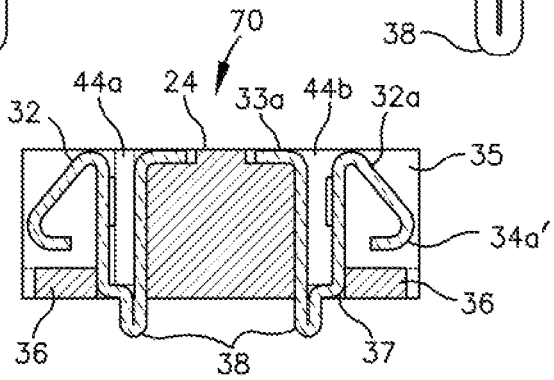
FIG. 6 is a cross-sectional view of an assembled sliding socket.
Figure 7:
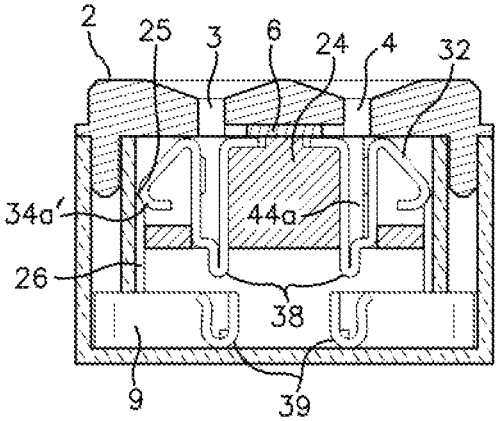
FIG. 7 is a side elevation cross-sectional view of the tamper resistant power receptacle taken along line 7-7 of FIG. 1 in a non-energized or neutral state.

The assembled sliding socket 70 is shown in a central longitudinal cross-section view in FIG. 6. The space between the side wall members 33*a* and 34*a* of the blade contacts 32 become slots 44*a* and 44*b* adapted to receive the neutral blade and hot blade of a plug respectively. Since the neutral blade of the common polarized plug is wider than the hot blade, the slot 44*a* in the assembled socket 70, the socket base 24 in FIG. 3 and slot 4 of the top cap 2 in FIG. 2 is wider to accommodate this wider blade. When installed in the one of the rectangular cavities 23*a* or 23*b* the sliding socket sits with its two lips 34*a*' on the short ramps 25 of the body 8, suspending the sliding socket 70 with its switch tabs 38 above the switch receivers 39 in the body assembly 8 as shown in FIG. 7. There is no electrical communication between the power bus 9 and the sliding socket 70.

Figure 8:
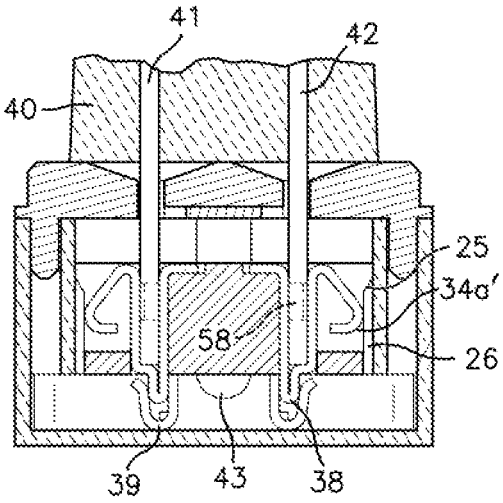
FIG. 8 is a side elevation cross-sectional view of the tamper resistant power receptacle taken along line 7-7 of FIG. 1 with a plug in an energized or powered state.

The working elements of the first exemplary embodiment of the tamper resistant power receptacle 1 are shown in FIGS. 7 and 8. FIG. 7 is a section view of the tamper resistant power receptacle 1 in an un-energized or unpowered state. The angularly depending lip 34*a*' of the sliding socket 24 causes interference with the short ramp 25, preventing electrical contact between the switch tab 38 and the power bus receiver 39. As shown in FIG. 7, the first and second sidewall members of the blade contacts 32 provide moderate resistance to compression by the short ramp 25, thus resisting the downward motion of the sliding socket 70. As shown in FIGS. 7 and 8, switch tab 38 and power bus receiver 39 cooperate to provide a switch 53.

As shown in FIG. 8, when a plug 40 (shown truncated, with hot blade 41, hot neutral blade 42, and ground blade 43) is inserted into the sliding socket 24, the user may exert a downward force on the plug 40 to overcome the resistance exerted by the angularly depending lip 34*a*' and the short ramp 25. Under the downward force, the angularly depending lip 34*a*' compresses inwardly locking the plug into the sliding socket 70 and the socket 70 slides down the short ramp 25 and ramp extension 26, positioning the switch tabs 38 of the blade contacts 32 into power bus switch receivers 39, powering the plug as shown in FIG. 8.

When the plug is retracted the sliding socket 24 retracts with it, breaking electrical communication between the power bus switch receivers 39 and switch tabs 38. When the sliding socket 24 reaches the top of its travel the angularly depending lip 34*a*' is positioned on top of the short ramp 25 in a decompressed state allowing plug 40 to be easily removed.

The resistance provided by the compression of the blade contact 32 as it moves downwardly along the short ramp 25 provides resistance and additional protection against unintentional energizing of the sliding socket 24 during receipt by the sliding socket 24 of undesired objects. Things commonly available to a child such as paper clips, hair or safety pins, or wires and needles do not have handles and would be difficult to push hard enough to overcome the resistance to slide the socket to power. This resistance provides a moderate degree of safety, thus qualifying as a safety receptacle.

The addition of a movement lock which requires features common to the power blades of plugs to unlock would greatly increase the safety of any receptacle which is switched to power by a movement, whether linear or rotational. Potential movement locks that are dependent on the flat bottom of the blades and the width of the blades are shown in FIGS. 9-14 schematically. The figures shown in FIG. 9-14 represent movable bodies residing in a cavity, having one or more resilient members with ends that protrude from the body, into receptors in the cavity to preventing movement. With the insertion of the proper "key" the resilient member ends are retracted into the body allowing the movement.

Figure 9:
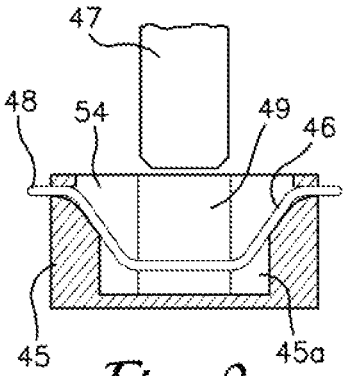
FIG. 9 is a cross-sectional view of an example movement lock keyed to the flat bottom of a plug blade used in the second exemplary embodiment of the tamper resistant receptacle.

FIG. 9 shows a movement lock which is keyed to a flat bottom key (blade 47). The body 45 has two slots, a rectangular one 49 to admit the key and one 54 in which the sides in the lower pan 54*a* are vertical forming the pocket 54*a*, but then rise angularly to accommodate the resilient member 46.

Figure 10:
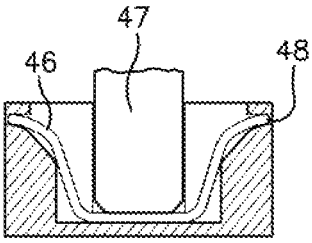
FIG. 10 is a cross-sectional view illustrating the unlocking of the movement lock of FIG. 9 by a plug blade.

The resilient member 46 is roughly "V" shaped with a central horizontal extension and horizontal end sections. The resilient member 46 ends 48 extend from outlets in the body 45 to engage with holes or slots in the cavity wall to prevent movement. When the key (blade) 47 is inserted the flat bottom presses the central flat portion of the resilient member 46 within the entrance slot 49 downward evenly into the pocket 54*a*. This retracts the ends 48 of the resilient member 46 into the body 45 as shown in FIG. 10, allowing the movement. If a foreign object 50 is inserted near the lateral sides of the entry slot 49, the resilient member 46 deforms as shown in FIG. 13, retracting only one end into the body 45 and movement is prevented.

Figure 11:
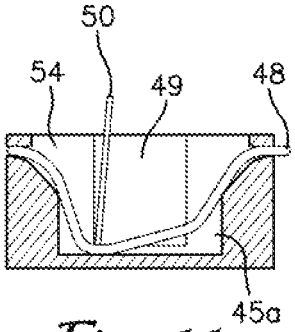
FIG. 11 is a cross-sectional view showing how the movement lock of FIG. 9 reacts to a foreign object inserted at a side of the blade slot.
Figure 12:
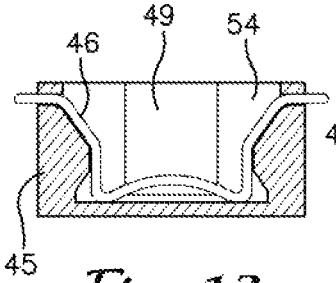
FIG. 12 is a cross-sectional view of an alternative movement lock keyed to a flat bottom blade which was not used in a receptacle.

FIG. 12 shows a movement lock which is similarly keyed to flat bottomed object and should be more selective than that shown in FIG. 11 since it would be harder to depress the center of the arch of the resilient member than the center of a flat resilient member. However, a material more resilient than ordinary spring wire is required, such as "memory metal", since a prototype showed that the design exceeded the elastic limit of ordinary spring wire. This example was not used in the present embodiments of the tamper resistant receptacle but remains a viable example of a movement lock.

Figure 13:
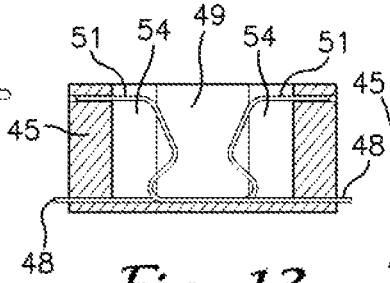
FIG. 13 is a cross-sectional view of an alternative movement lock keyed to the width of a blade.

FIG. 13 depicts a movement lock which is keyed to the width of an inserted key. The body 45 has a slot 54 which is twice the width of a resilient member 51 to accommodate two resilient members 51, a key slot 49, and outlets holes for the ends 48 of the resilient members 51 on opposite sides of the body 45. The resilient members 51 are shaped roughly like a "Z" or a backwards "S", starting from the top installation hole, running horizontally to the edge of the key slot 49, turning at an angle to intrude partially into the key slot 49, then returning at a sharper angle going outside the key slot, turning sharply in the opposite direction to run horizontally across the bottom of both its slot 54 and the key slot 49, and out the lower outlet in the opposite side of the body. One resilient member 51 is installed on each side of the lock body 46. When the key 47 (blade) is inserted it spreads the intruding portions of the resilient members 51 and retracts the ends 48 into the body allowing movement.

Figure 15:
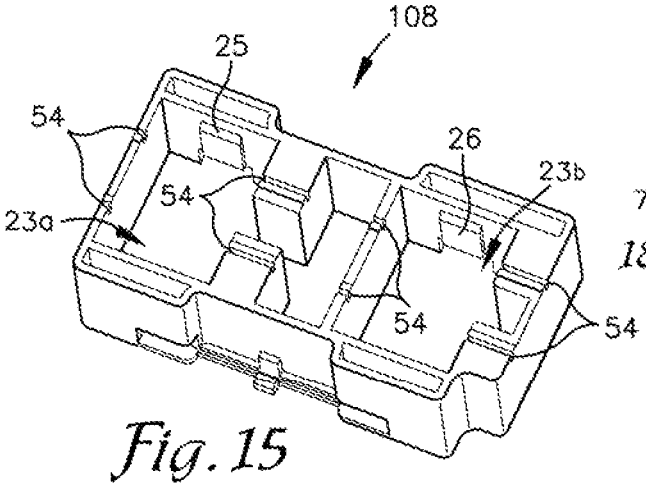
FIG. 15 is a front perspective view of the body of the second exemplary embodiment of the tamper resistant power receptacle represented by FIG. 1 which utilizes the movement lock of FIGS. 9-11.

The second exemplary embodiment of the tamper resistant receptacle represented by FIG. 1 uses the movement lock of the type shown in FIGS. 9-11. This receptacle utilizes the items described in FIG. 2 and the same blade contacts 32 and 33 shown in FIGS. 3-5 as the previously described receptacle. FIG. 15 illustrates the alternative body 108 adapted for use with an alternative sliding socket 170 illustrated in FIGS. 16-18. The a body 108 has the same structure and features as previously described in association with body 8 in FIG. 3, including the power busses 9 with their switch receivers 39 which are not shown, Additionally the body 108 has a plurality of parallel slots 54 running in straight lines longitudinally through the top of the body 108, adapted for receipt of resilient member ends 48 associated with the sliding socket 170 depicted in FIG. 16. As illustrated in FIG. 15 the body 108 includes upper and lower recesses 23*a* and 23*b* which are adapted for receipt of the sliding socket 170, a short ramp 25, and ramp extension 26. The ramp 25 supports the socket 170 in the unpowered state and provides resistance during movement of the sliding socket 170 between an un-powered state and an energized condition.

Figure 16:
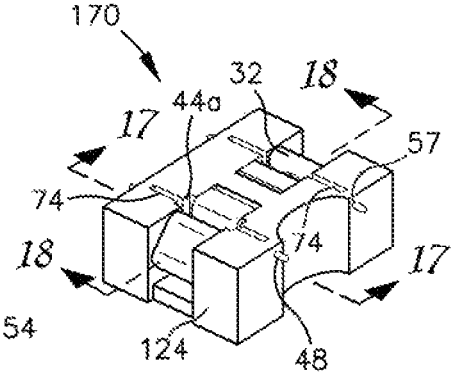
FIG. 16 is a front perspective view of the sliding socket assembly of the second exemplary embodiment of the tamper resistant receptacle represented by FIG. 1, which employs the movement lock of FIGS. 9-11.
Figure 17:
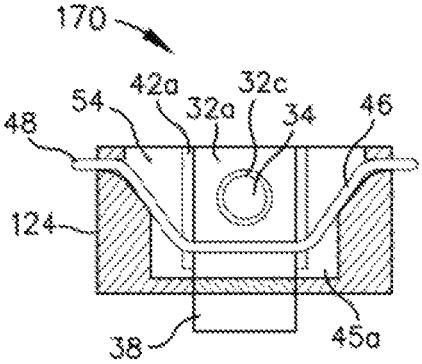
FIG. 17 is a magnified cross-sectional view of the assembled sliding socket of FIG. 16 along the line 17-17.
Figure 18:
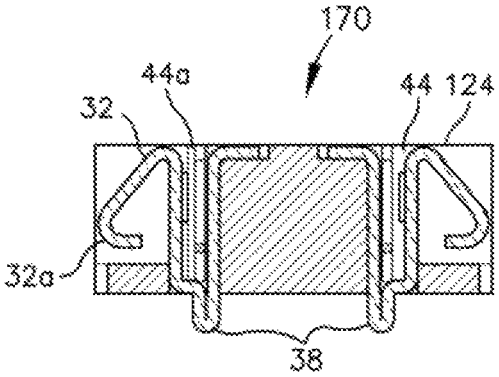
FIG. 18 is a cross-sectional view of the sliding socket assembly of FIG. 16 along the line 18-18.

The sliding socket 170 shown in FIGS. 16, 17 and 18 has the same general structure as the previously described sliding socket 70, with the addition of two extra slots 74 in the socket base 124 which house the resilient member 46 of the movement lock as shown in FIG. 17. The movement lock slots 74 lie parallel to and bisect the blade slots 44 and 44*a*, being wide enough to allow reciprocal and projected movement of the resilient member 48 as further described herein.

Figure 19:
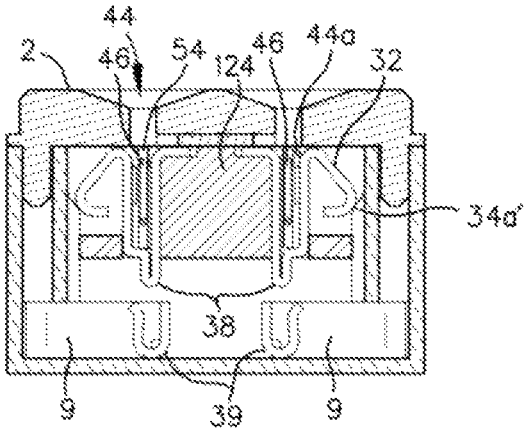
FIG. 19 is a cross-sectional view of the second exemplary embodiment of the tamper resistant receptacle represented by FIG. 1 along the line 7-7.

When installed in one of the rectangular cavities 23*a* or 23*b* in the body 108, the depending lips 34*a*' of the sliding socket 170 sit on the short ramp 25 suspending the switch tabs 38 above the switch receivers 39 as shown in FIG. 19. The ends 48 of the resilient member 46 lie in slots 54, close to but not touching the bottoms of the slots 54.

The operation of the tamper resistant receptacle is best shown in FIG. 19 which is a cross-section view looking in the direction of the arrows 7-7 in FIG. 1. When a plug is inserted into this second embodiment of the tamper resistant receptacle represented by FIG. 1, the power blades pass through the power slots 3 and 4 of the top cap 2 (FIG. 2), pass into slots 44 and 44*a* (FIG. 18), press the resilient members 46 into the pocket 45*a* (FIG. 17), retracting the resilient member ends 48 into the socket 170. Further pressure on the plug overcomes the moderate resistance provided by the compression of the blades by the blade contacts' dependent lips 34*a*' (FIG. 19) interference with short ramp 25 (FIG. 15) locking the plug into the sliding socket assembly, or plug blade locking mechanism 170, sliding the assembly 170 down the ramp 25 and ramp extension 26, placing the switch tabs 38 into the switch receivers 39, thus powering the plug. It is important that the force necessary to deform the resilient members 46 be less than the force to overcome the moderate resistance of blade compression so that the resilient member ends 48 do not touch the sidewalls of the rectangular cavities 23*a* or 23*b* during the slide to power, causing wear.

When the plug is retracted the sliding socket 170 is retracted with it. When the upward motion of the sliding socket 170 reaches the top cap 2 the lips 34*a*' of the blade contacts 32 are sitting on top of the ramp 25 decompressed, freeing the plug blades and the relaxing resilient members 46 to reestablish the movement lock.

If a foreign object is inserted into the receptacle which does not have a flat bottom to push equally on both sides of the resilient member 46 of the movement lock, the resilient member 46 may distort unsymmetrically as shown schematically in FIG. 11, failing to unlock the movement lock. A thin object such as a needle may not even contact the resilient member 46, thus leaving the movement lock in the locked state. Furthermore, both movement locks in the sliding socket 170 must be unlocked to allow the slide to power, so two foreign objects would have to be used, both of them pushing on the resilient member 46 in the correct spot to unlock the movement lock. Thus it would be difficult for even two foreign objects or a paper clip bent in a U shape to unlock the movement lock and slide the socket to power.

Figure 14:
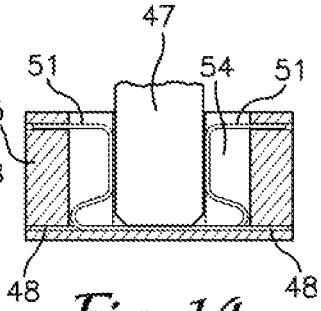
FIG. 14 is a cross-sectional view illustrating how a plug blade of proper width unlocks the movement lock.
Figure 20:
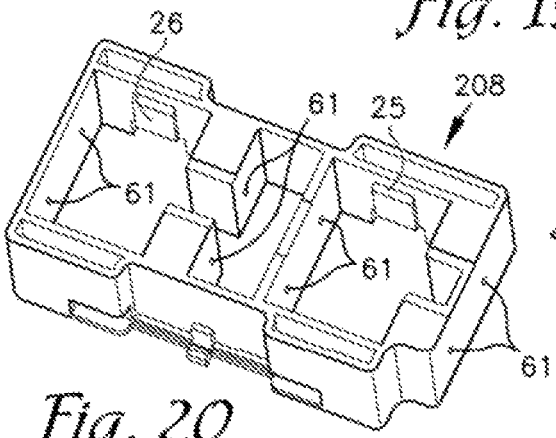
FIG. 20 is a front perspective view of the body of the third exemplary embodiment of the tamper resistant receptacle represented by FIG. 1 utilizing the movement lock of FIGS. 13 and 14.
Figure 21:
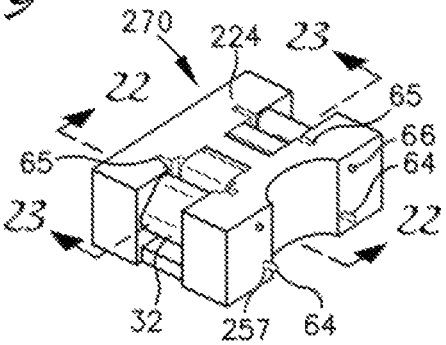
FIG. 21 is a front perspective view of the sliding socket assembly of the third exemplary embodiment represented by FIG. 1.

The third exemplary sliding socket embodiment of the improved tamper resistant receptacle uses the movement lock shown in FIGS. 13 and 14. The body 208 shown in FIG. 20 has all of the features of the body 8 in FIG. 1 including power busses 9 with switch receivers 39 (not shown in FIG. 20). The movement lock requires eight receivers 61 in the walls of the receptacle body 208 for the ends 64 of the resilient members 63. These receivers should have a vertical dimension somewhat greater than the diameter of the resilient members 63 so that the ends 64 of the resilient members 63 lie close to but do not touch the bottoms of the receivers 61 as discussed earlier with the second exemplary embodiment of the tamper resistant receptacle employing the movement lock of FIG. 9.

The sliding socket 270 of this third exemplary receptacle is shown in FIGS. 21-24. The socket base 224 has the same general structure of socket base 24 of FIG. 3, and can optionally use either blade contacts 32*a* or 32*b*. Additionally the socket base 224 has two slots 65 for the resilient members 63, four holes 66 for installation of the resilient members 63, and four exit openings 257 for the resilient member ends 64. The slots 65 for the resilient members 63 are rectangular and bisect the blade slots (labeled 44*a* and

Figure 22:
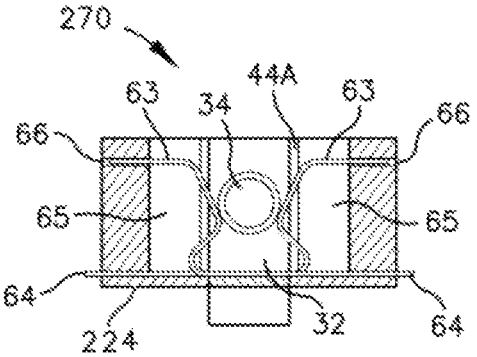
FIG. 22 is a magnified cross-sectional view of the sliding socket of FIG. 21 along the line 22-22 showing the movement lock of FIG. 13.
Figure 23:
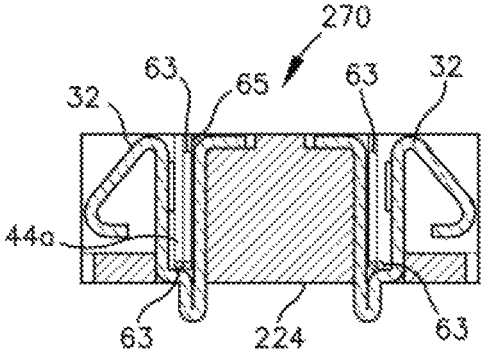
FIG. 23 is a cross-sectional view of the sliding socket assembly of FIG. 21 along the line 23-23.
Figure 24:
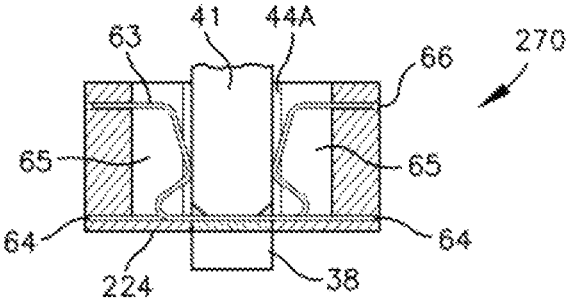
FIG. 24 is a cross-sectional view of the sliding socket assembly of FIG. 21 with a narrow plug blade in the power slot.
Figure 25:
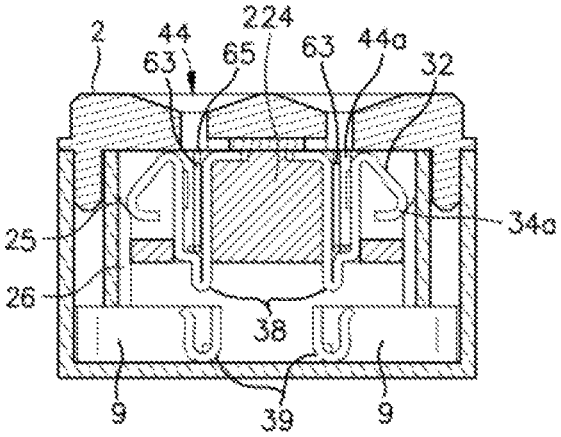
FIG. 25 is a side elevation cross-sectional view of the third exemplary embodiment of the tamper resistant power receptacle taken along line 7-7 in FIG. 1.

44*b* in FIG. 25) as shown in the section views FIGS. 22 and 24. Each slot 65 is adapted for receiving a pair of resilient members which lie parallel to one another, being installed with adhesive or a tight friction fit in the upper holes 66 on opposite sides of the socket assembly 170. Both resilient members 63 intrude into the blade slots 44 or 44*a*, then turning and passing along the bottom of the slot 44 or 44*a* and exiting from the lower outlet 257 on the side opposite its installation. The distance of the intrusion into the blade slot 44 or 44*a* determines the distance the end will be retracted. In the case of blade slot 44 this distance can be set very accurately so that the movement lock is very selective, opening only for a very specific blade width. If the blade is too wide it will not fit into the blade slot 44, whereas if it is too narrow the end 64 of the resilient member will not be retracted enough. However, the situation is different in the blade slot 44*a* because it has to accommodate both the narrow blade 41 of a three prong plug and the wider blade of a polarized plug (not shown). As shown in FIG. 24, the intrusion has to be set so that the narrower blade in blade slot 44*a* completely retracts the resilient member ends 64 into the sliding socket 270. Again, it is important that the resistance provided by the compression of the plug blades prevent sliding to power until the plug blades have reached to bottom of the of the blade slots 44 and 44*a*, otherwise the opening of the movement lock will cause wear on the sidewalls of the rectangular cavities 23*a* and 23*b* and might even create an unsafe condition.

The slide to power is best illustrated in association with FIG. 25, and the sequence is analogous to that of the second exemplary tamper resistant receptacle. When a plug is inserted, the blades contact the intrusions of the resilient members 63 into the blade slots 44 and 44*a*, retracting the resilient member ends 64 into the sliding socket 270 (FIGS. 22 and 24). Further pushing on the plug overcomes the resistance and the blade contacts 32 compress the plug blades as the dependent lips 34*a* slide down the short ramp 25 and the ramp extension 26, locking the plug into the sliding socket 270 and slipping the switch tabs 38 into the switch receivers 39 to power the plug.

When the plug is retracted the sliding socket 170 is retracted with it. When the upward slide reaches the top cap 2 the lips 34*a*' of the blade contacts 32 are sitting on the ramp 25 decompressed, freeing the plug blades. When the plug is removed from the socket the movement lock is reestablished. The movement lock employed in this exemplary embodiment is by far the hardest to defeat.

Figure 26:
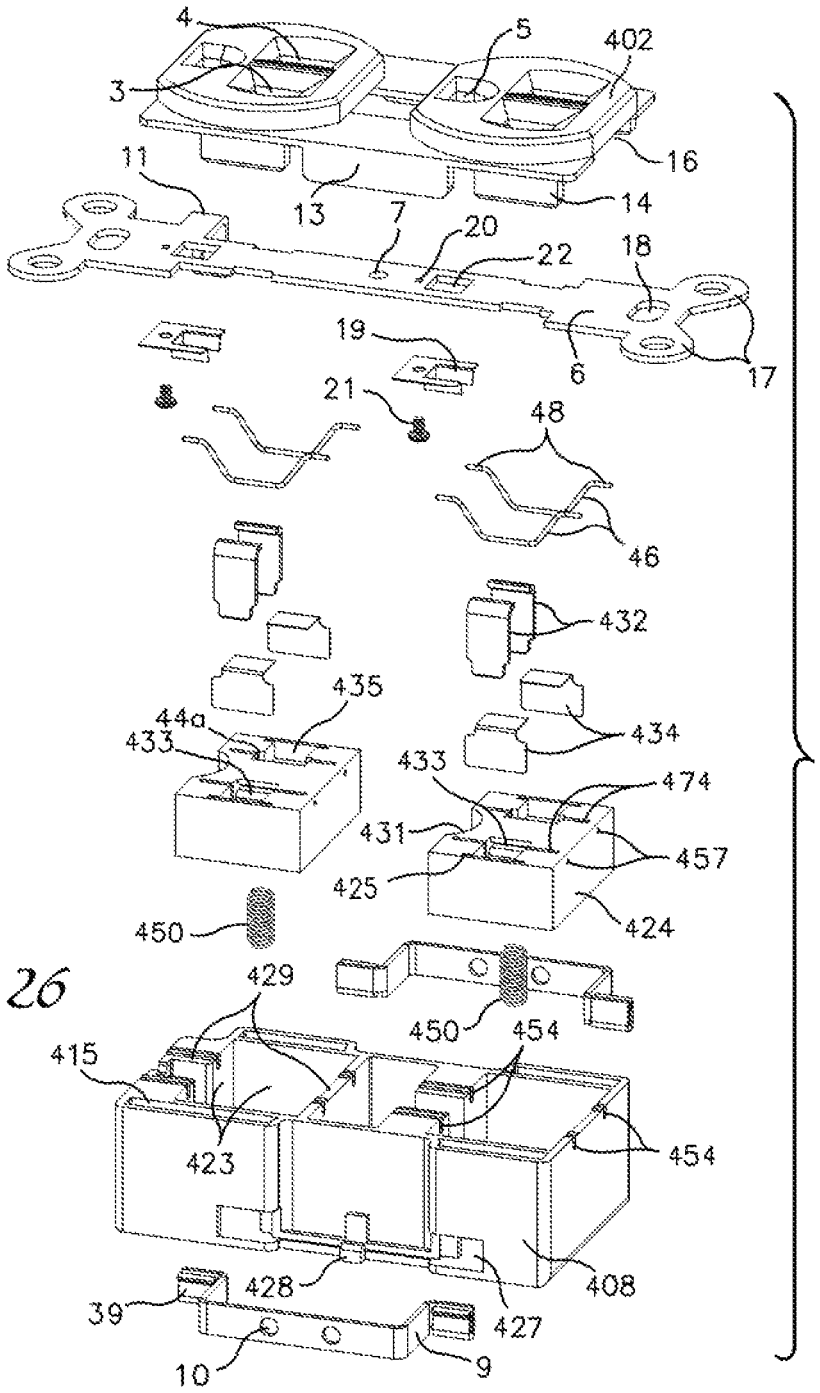
FIG. 26 is an exploded side elevation of the fourth exemplary embodiment of a sliding socket tamper resistant power receptacle represented by FIG. 1 using the FIG. 9 movement lock.
Figure 27:
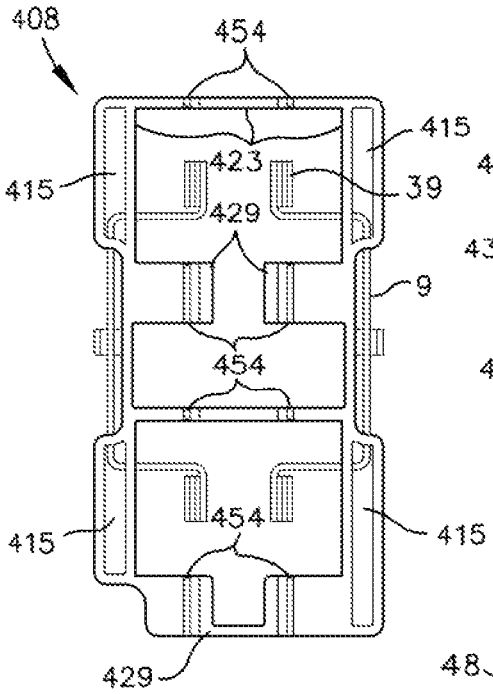
FIG. 27 is a top plan view of the body assembly of the fourth tamper resistant power receptacle of FIG. 26.
Figure 34:
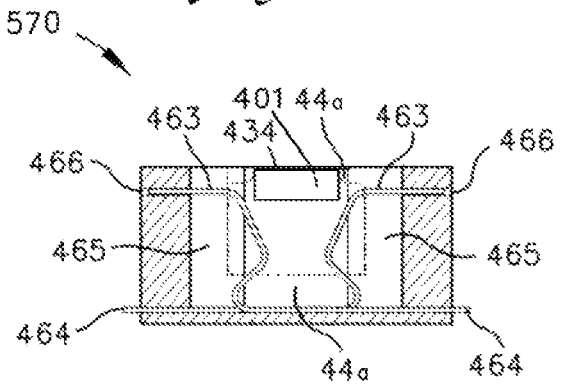
FIG. 34 is a cross-sectional view of a socket assembly using the movement lock of FIGS. 13 and 14, along the line 29-29 in FIG. 28.

The fourth exemplary embodiment of the shown in exploded view in FIG. 26 uses a different blade locks and resistance methods from the previous three embodiments. It employs the movement lock shown in FIGS. 9-11, although the body 408 and sliding socket 470 of this receptacle could also be modified to accommodate the movement lock of FIGS. 13 and 14 as indicated in FIG. 34. The general shape of the parts of this sliding socket receptacle are shown in the exploded view FIG. 26. The body 408 of this fourth exemplary embodiment of the sliding socket receptacle represented by FIG. 1 is shown in FIGS. 26 and 27. This body 408 lacks the ramps and ramp extensions common to the first three embodiments of the receptacle 1 in FIG. 1, but apart from this exception it is identical to the body 208 of the second embodiment shown in FIG. 15. It is shown with power strips 9 and their switch receivers 39 installed in FIG. 27. It includes the two rectangular recesses 423 and the eight slots 454 discussed previously which are required for the movement lock shown in FIGS. 9-11. The other features of this body were discussed previously.

Figure 28:
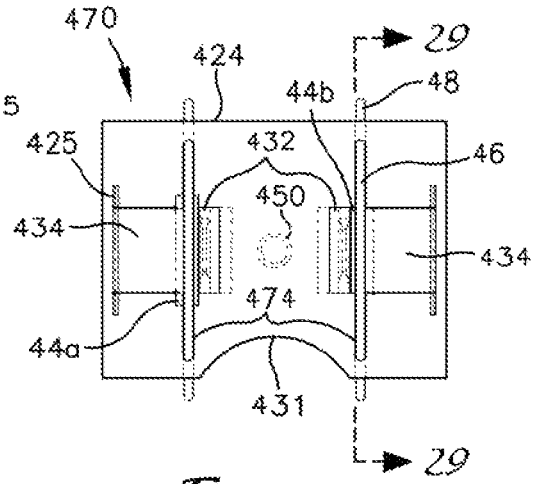
FIG. 28 is a top plan view of an assembled sliding socket of the tamper resistant power receptacle of FIG. 26.
Figure 29:
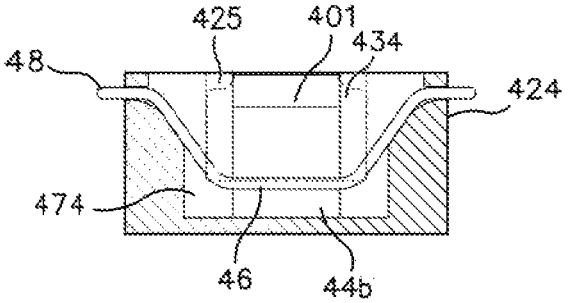
FIG. 29 is a side elevation cross-sectional view of the assembled sliding socket of FIG. 28 along the line 29-29.
Figure 30:
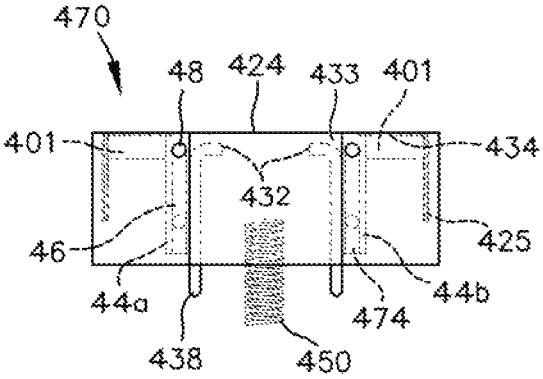
FIG. 30 is a front elevation of the sliding socket assembly of FIG. 28.
Figure 31:
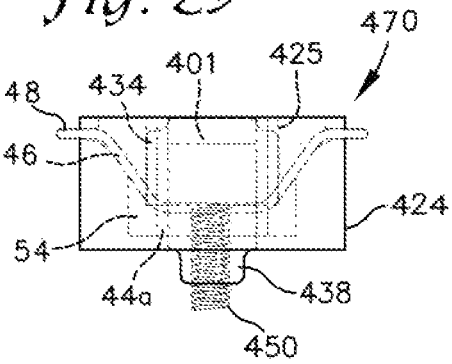
FIG. 31 is an end elevation of the sliding socket assembly of FIG. 28.

A sliding socket assembly 470 of this fourth embodiment of the receptacle represented by FIG. 1 is assembled from the socket base 424, two blade contacts 432, two blade lock springs 434, two movement lock resilient members 46, and a resistance coil spring 450. The socket base 434 is basically a rectangular block with the arcuate cutout 431 common to all the sliding socket bases as shown in FIG. 28. Other features of the socket base are shown in FIGS. 26, and 28-31. The socket base 424 has rectangular slots 425 near its longitudinal ends adapted for receipt of "L" shaped blade lock springs 434, recesses 401 whose purpose is to allow the short ends of the blade lock springs 434 to bend downward, and two slots 433 adapted to mount the blade contacts 432 which protrude through the lower ends of these slots to present switch tabs 438. The blade slots 44*a* and 44*b* for the neutral and hot blades of a plug (not shown) are formed between the blade contacts 432 and the outer wall of this slot as shown in FIG. 30. A spring 450 provides resistance to the movement of the socket until the plug is all the way into the socket and then a user can slide it down to power and is installed in a centrally located recess in the bottom of the socket base.

When the plug is retracted the sliding socket 24 retracts with it, breaking electrical communication between the power bus switch receivers 39 and switch tabs 38. When the sliding socket 24 reaches the top of its travel the angularly depending lip 34*a*' is positioned on top of the short ramp 25 in a decompressed state allowing plug 40 to be easily removed.

The resistance provided by the compression of the blade contact 32 as it moves downwardly along the short ramp 25 provides resistance and additional protection against unintentional energizing of the sliding socket 24 during receipt by the sliding socket 24 of undesired objects. Things commonly available to a child such as paper clips, hair or safety pins, or wires and needles do not have handles and would be difficult to push hard enough to overcome the resistance to slide the socket to power. This resistance provides a moderate degree of safety, thus qualifying as a safety receptacle.

The addition of a movement lock which requires features common to the power blades of plugs to unlock would greatly increase the safety of any receptacle which is switched to power by a movement, whether linear or rotational. Potential movement locks that are dependent on the flat bottom of the blades and the width of the blades are shown in FIGS. 9-14 schematically. The figures shown in FIG. 9-14 represent movable bodies residing in a cavity, having one or more resilient members with ends that protrude from the body, into receptors in the cavity to preventing movement. With the insertion of the proper "key" the resilient member ends are retracted into the body allowing the movement.

FIG. 9 shows a movement lock which is keyed to a flat bottom key (blade 47). The body 45 has two slots, a rectangular one 49 to admit the key and one 54 in which the sides in the lower part 54*a* are vertical forming the pocket 54*a*, but then rise angularly to accommodate the resilient member 46. The resilient member 46 is roughly "V" shaped with a central horizontal extension and horizontal end sections. The resilient member 46 ends 48 extend from outlets in the body 45 to engage with holes or slots in the cavity wall to prevent movement. When the key (blade) 47 is inserted the flat bottom presses the central flat portion of the resilient member 46 within the entrance slot 49 downward evenly into the pocket 54*a*. This retracts the ends 48 of the resilient member 46 into the body 45 as shown in FIG. 10, allowing the movement. If a foreign object 50 is inserted near the lateral sides of the entry slot 49, the resilient member 46 deforms as shown in FIG. 13, retracting only one end into the body 45 and movement is prevented.

FIG. 12 shows a movement lock which is similarly keyed to a flat bottomed object and should be more selective than that shown in FIG. 11 since it would be harder to depress the center of the arch of the resilient member than the center of a flat resilient member. However, a material more resilient than ordinary spring wire is required, such as "memory metal", since a prototype showed that the design exceeded the elastic limit of ordinary spring wire. This example was not used in the present embodiments of the tamper resistant receptacle but remains a viable example of a movement lock.

FIG. 13 depicts a movement lock which is keyed to the width of an inserted key. The body 45 has a slot 54 which is twice the width of a resilient member 51 to accommodate two resilient members 51, a key slot 49, and outlets holes for the ends 48 of the resilient members 51 on opposite sides of the body 45. The resilient members 51 are shaped roughly like a "Z" or a backwards "S", starting from the top installation hole, running horizontally to the edge of the key slot 49, turning at an angle to intrude partially into the key slot 49, then returning at a sharper angle going outside the key slot, turning sharply in the opposite direction to run horizontally across the bottom of both its slot 54 and the key slot 49, and out the lower outlet in the opposite side of the body. One resilient member 51 is installed on each side of the lock body 46. When the key 47 (blade) is inserted it spreads the intruding portions of the resilient members 51 and retracts the ends 48 into the body allowing movement.

The second exemplary embodiment of the tamper resistant receptacle represented by FIG. 1 uses the movement lock of the type shown in FIGS. 9-11. This receptacle utilizes the items described in FIG. 2 and the same blade contacts 32 and 33 shown in FIGS. 3-5 as the previously described receptacle. FIG. 15 illustrates the alternative body 108 adapted for use with an alternative sliding socket 170 illustrated in FIGS. 16-18. The a body 108 has the same structure and features as previously described in association with body 8 in FIG. 3, including the power busses 9 with their switch receivers 39 which are not shown, Additionally the body 108 has a plurality of parallel slots 54 running in straight lines longitudinally through the top of the body 108, adapted for receipt of resilient member ends 48 associated with the sliding socket 170 depicted in FIG. 16. As illustrated in FIG. 15 the body 108 includes upper and lower recesses 23*a* and 23*b* which are adapted for receipt of the sliding socket 170, a short ramp 25, and ramp extension 26. The ramp 25 supports the socket 170 in the unpowered state and provides resistance during movement of the sliding socket 170 between an un-powered state and an energized condition.

The sliding socket 170 shown in FIGS. 16, 17 and 18 has the same general structure as the previously described sliding socket 70, with the addition of two extra slots 74 in the socket base 124 which house the resilient member 46 of the movement lock as shown in FIG. 17. The movement lock slots 74 lie parallel to and bisect the blade slots 44 and 44*a*, being wide enough to allow reciprocal and projected movement of the resilient member 48 as further described herein.

When installed in one of the rectangular cavities 23*a* or 23*b* in the body 108, the depending lips 34*a*' of the sliding socket 170 sit on the short ramp 25 suspending the switch tabs 38 above the switch receivers 39 as shown in FIG. 19. The ends 48 of the resilient member 46 lie in slots 54, close to but not touching the bottoms of the slots 54.

The operation of the tamper resistant receptacle is best shown in FIG. 19 which is a cross-section view looking in the direction of the arrows 7-7 in FIG. 1. When a plug is inserted into this second embodiment of the tamper resistant receptacle represented by FIG. 1, the power blades pass through the power slots 3 and 4 of the top cap 2 (FIG. 2), pass into slots 44 and 44*a* (FIG. 18), press the resilient members 46 into the pocket 45*a* (FIG. 17), retracting the resilient member ends 48 into the socket 170. Further pressure on the plug overcomes the moderate resistance provided by the compression of the blades by the blade contacts' dependent lips 34*a*' (FIG. 19) interference with short ramp 25 (FIG. 15) locking the plug into the sliding socket assembly 170, sliding the assembly 170 down the ramp 25 and ramp extension 26, placing the switch tabs 38 into the switch receivers 39, thus powering the plug. It is important that the force necessary to deform the resilient members 46 be less than the force to overcome the moderate resistance of blade compression so that the resilient member ends 48 do not touch the sidewalls of the rectangular cavities 23*a* or 23*b* during the slide to power, causing wear.

When the plug is retracted the sliding socket 170 is retracted with it. When the upward motion of the sliding socket 170 reaches the top cap 2 the lips 34*a*' of the blade contacts 32 are sitting on top of the ramp 25 decompressed, freeing the plug blades and the relaxing resilient members 46 to reestablish the movement lock.

If a foreign object is inserted into the receptacle which does not have a flat bottom to push equally on both sides of the resilient member 46 of the movement lock, the resilient member 46 may distort unsymmetrically as shown schematically in FIG. 11, failing to unlock the movement lock. A thin object such as a needle may not even contact the resilient member 46, thus leaving the movement lock in the locked state. Furthermore, both movement locks in the sliding socket 170 must be unlocked to allow the slide to power, so two foreign objects would have to be used, both of them pushing on the resilient member 46 in the correct spot to unlock the movement lock. Thus it would be difficult for even two foreign objects or a paper clip bent in a U shape to unlock the movement lock and slide the socket to power.

The third exemplary sliding socket embodiment of the improved tamper resistant receptacle uses the movement lock shown in FIGS. 13 and 14. The body 208 shown in FIG. 20 has all of the features of the body 8 in FIG. 1 including power busses 9 with switch receivers 39 (not shown in FIG. 20). The movement lock requires eight receivers 61 in the walls of the receptacle body 208 for the ends 64 of the resilient members 63. These receivers should have a vertical dimension somewhat greater than the diameter of the resilient members 63 so that the ends 64 of the resilient members 63 lie close to but do not touch the bottoms of the receivers 61 as discussed earlier with the second exemplary embodiment of the tamper resistant receptacle employing the movement lock of FIG. 9.

The sliding socket 270 of this third exemplary receptacle is shown in FIGS. 21-24. The socket base 224 has the same general structure of socket base 24 of FIG. 3, and can optionally use either blade contacts 32*a* or 32*b*. Additionally the socket base 224 has two slots 65 for the resilient members 63, four holes 66 for installation of the resilient members 63, and four exit openings 257 for the resilient member ends 64. The slots 65 for the resilient members 63 are rectangular and bisect the blade slots (labeled 44*a* and 44*b* in FIG. 25) as shown in the section views FIGS. 22 and 24. Each slot 65 is adapted for receiving a pair of resilient members which lie parallel to one another, being installed with adhesive or a tight friction fit in the upper holes 66 on opposite sides of the socket assembly 170. Both resilient members 63 intrude into the blade slots 44 or 44*a*, then turning and passing along the bottom of the slot 44 or 44*a* and exiting from the lower outlet 257 on the side opposite its installation. The distance of the intrusion into the blade slot 44 or 44*a* determines the distance the end will be retracted. In the case of blade slot 44 this distance can be set very accurately so that the movement lock is very selective, opening only for a very specific blade width. If the blade is too wide it will not fit into the blade slot 44, whereas if it is too narrow the end 64 of the resilient member will not be retracted enough. However, the situation is different in the blade slot 44*a* because it has to accommodate both the narrow blade 41 of a three prong plug and the wider blade of a polarized plug (not shown). As shown in FIG. 24, the intrusion has to be set so that the narrower blade in blade slot 44*a* completely retracts the resilient member ends 64 into the sliding socket 270. Again, it is important that the resistance provided by the compression of the plug blades prevent sliding to power until the plug blades have reached to bottom of the of the blade slots 44 and 44*a*, otherwise the opening of the movement lock will cause wear on the sidewalls of the rectangular cavities 23*a* and 23*b* and might even create an unsafe condition.

The slide to power is best illustrated in association with FIG. 25, and the sequence is analogous to that of the second exemplary tamper resistant receptacle. When a plug is inserted, the blades contact the intrusions of the resilient members 63 into the blade slots 44 and 44*a*, retracting the resilient member ends 64 into the sliding socket 270 (FIGS. 22 and 24). Further pushing on the plug overcomes the resistance and the blade contacts 32 compress the plug blades as the dependent lips 34*a* slide down the short ramp 25 and the ramp extension 26, locking the plug into the sliding socket 270 and slipping the switch tabs 38 into the switch receivers 39 to power the plug.

When the plug is retracted the sliding socket 170 is retracted with it. When the upward slide reaches the top cap 2 the lips 34*a'* of the blade contacts 32 are sitting on the ramp 25 decompressed, freeing the plug blades. When the plug is removed from the socket the movement lock is reestablished. The movement lock employed in this exemplary embodiment is by far the hardest to defeat.

The fourth exemplary embodiment of the shown in exploded view in FIG. 26 uses a different blade locks and resistance methods from the previous three embodiments. It employs the movement lock shown in FIGS. 9-11, although the body 408 and sliding socket 470 of this receptacle could also be modified to accommodate the movement lock of FIGS. 13 and 14 as indicated in FIG. 34. The general shape of the parts of this sliding socket receptacle are shown in the exploded view FIG. 26. The body 408 of this fourth exemplary embodiment of the sliding socket receptacle represented by FIG. 1 is shown in FIGS. 26 and 27. This body 408 lacks the ramps and ramp extensions common to the first three embodiments of the receptacle 1 in FIG. 1, but apart from this exception it is identical to the body 208 of the second embodiment shown in FIG. 15. It is shown with power strips 9 and their switch receivers 39 installed in FIG. 27. It includes the two rectangular recesses 423 and the eight slots 454 discussed previously which are required for the movement lock shown in FIGS. 9-11. The other features of this body were discussed previously.

A sliding socket assembly 470 of this fourth embodiment of the receptacle represented by FIG. 1 and shown in FIGS. 28-31 is assembled from the socket base 424, two blade contacts 432, two blade lock springs 434, two movement lock resilient members 46, and a resistance coil spring 450. The socket base 424 is basically a rectangular block with the arcuate cutout 431 common to all the sliding socket bases as shown in FIG. 28. Other features of the socket base are shown in FIGS. 26, and 28-31. The socket base 424 has rectangular slots 425 near its longitudinal ends adapted for receipt of "L" shaped blade lock springs 434, recesses 401 whose purpose is to allow the short ends of the blade lock springs 434 to bend downward, and two slots 433 adapted to mount the blade contacts 432 which protrude through the lower ends of these slots to present switch tabs 438. The blade slots 44*a* and 44*b* for the neutral and hot blades of a plug (not shown) are formed between the blade contacts 432 and the outer wall of this slot as shown in FIG. 30. A spring 450 providing resistance to the slide to power is installed in a centrally located recess in the bottom of the socket base.

Figure 32:
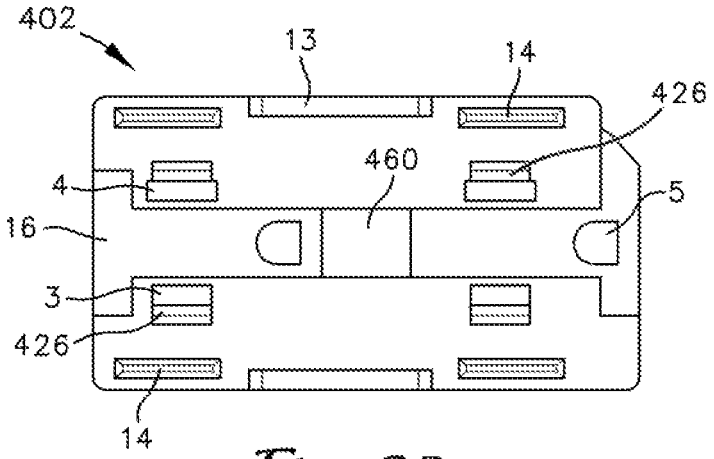
FIG. 32 is a bottom view of the top cap shown in FIG. 26.
Figure 33:
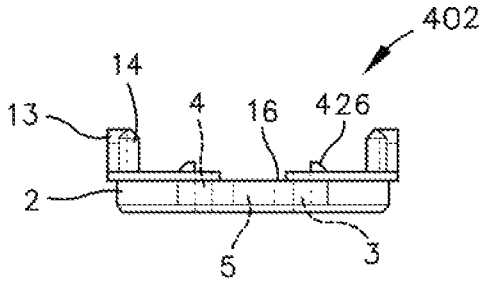
FIG. 33 is an end elevation of the top cap of FIG. 32.

The blade lock 434 springs have an inverted "L" shape, where the short side is long enough to intrude slightly into the blade slots 44*a* and 44*b*. In the assembled receptacle as shown in FIG. 1 the sliding assembly 470 is kept at the top of its travel (no plug inserted) by the spring 450 so that the nubs 426 on the underside of top cap 2 shown in FIGS. 32 and 33 push the short side of the blade lock spring 434 into the recess 401, opening the slots 44*a* and 44*b* allowing free passage of plug blades. When the sockets assemblies 470 are installed in the body 408 compartments 23, the spring 450 supports each sliding socket 470 at the top of its travel and against the top cap 2 in the assembled receptacle. In this position the switch tabs 438 are held above the switch receivers 39 on the power busses 9 and the ends 48 of the resilient members 46 are suspended slightly above the bottoms of the body slots 454. When a plug is inserted the plug power blades contact the movement lock resilient members 46, pushing them into the "pocket" 44*b* (FIG. 29) which retracts the ends 48 into the socket assembly 470, allowing further pressure to slide the socket assembly 470 causing the blade lock springs 434 to contact the plug blades and sliding the blade contact ends 438 into the switch receivers 39 on the power busses 9, thus powering the plug. When the plug is pulled upward the blade lock springs jam the plug blades so that the socket assembly 470 is pulled up with the plug. At the top cap 402 the numbs 426 push the blade lock springs back down into the recess 401 allowing free removal of the plug. As described here and with both the second and third exemplary receptacles, resistance allows the movement locks to unlock with the insertion of a plug before the slide to power, thus preventing wear. The presently described embodiment, but without the resistance spring 450, was the first prototype constructed. In this prototype the movement lock alone prevented the slide to power. After only a few plug insertions traces of wear were observed in the socket base 408. The addition of the resistance spring 450 stopped the wear, proving the importance of this moderate resistance in sliding socket receptacles with movement locks. This spring 450, however, required the friction fit of the switch tabs in the switch receivers 39 to counter the upward force of the spring 450, thus preventing disconnection of the switch tabs 438 from the switch receivers 39. The ramp and depending lip spring type of resistance employed in the first three exemplary receptacles did not exert an upward force on the sliding socket, and thus is the superior design. However, the present receptacle was operable, it illustrated a different type of blade lock 437 which can be adapted to sliding socket receptacles, and its' somewhat undesirable qualities led to the better designs.

This fourth exemplary receptacle can also be adapted to use the movement lock of FIGS. 13 and 14. FIG. 34, which is a section view analogous to FIG. 26, shows the adaptation of the sliding socket base 424 to accommodate the alternative movement lock. The modified sliding socket 570 requires a base analogous to that of FIG. 20 with holes 61, but without the ramp 25 and ramp extension 26.

Figure 35:
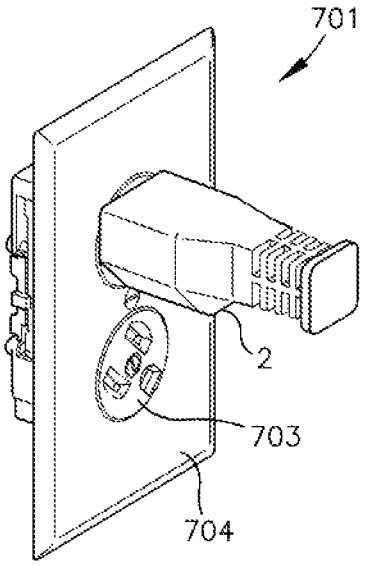
FIG. 35 is a side perspective view of an exemplary embodiment of a tamper resistant receptacle with a rotary switched sockets and a powered plug in the upper socket.
Figure 37:
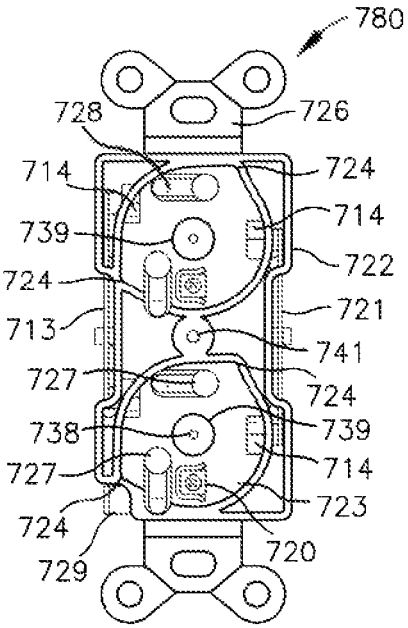
FIG. 37 is a front plan view of the assembled body of the rotationally switched receptacle of FIG. 35 with the socket assemblies, plug, and face plate removed.
Figure 36:
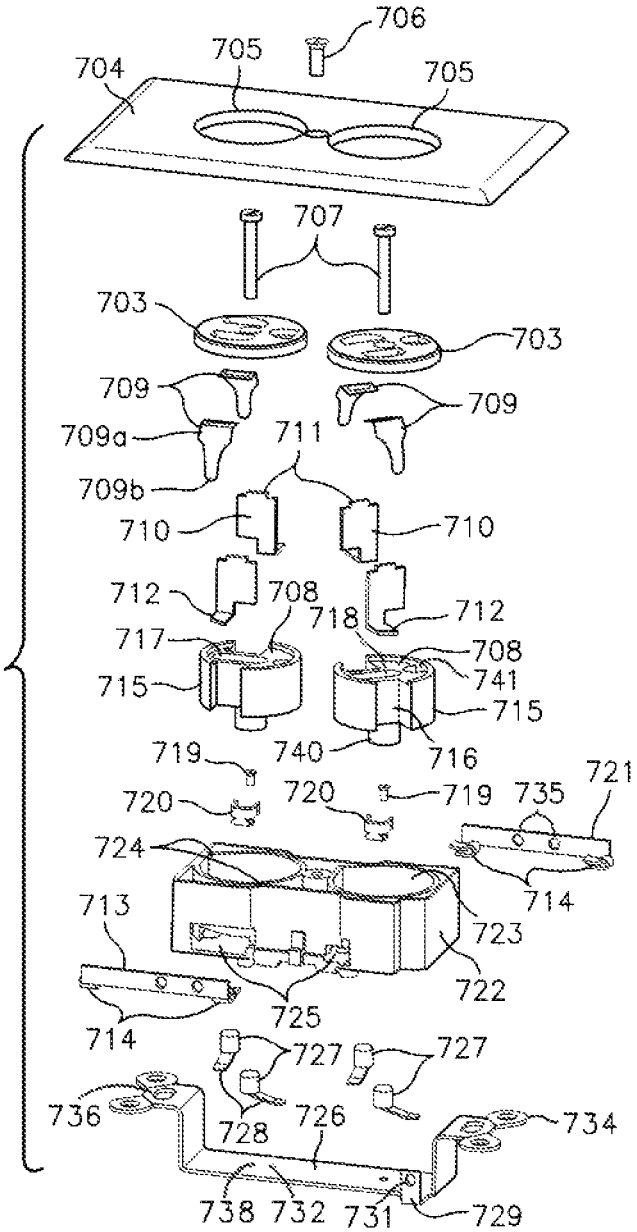
FIG. 36 is an exploded side elevation of an assembled rotationally switched receptacle.

FIG. 35 shows the fifth exemplary embodiment of a tamper resistant power receptacle 701 which uses a rotary motion to energize a plug. The receptacle 701 is shown with a plug in the energized state in the top socket, whereas the bottom socket is not energized. To power a plug with this receptacle 701 the plug is inserted into the socket 703 and is rotated approximately 45 degrees clockwise. The rotation locks the plug into the socket and closes a switch. This rotary receptacle 701 is substantially the same size and shape for receipt within a standard outlet enclosure or junction box (not shown), but because the socket tops 703 rotate and are round, the receptacle 701 requires a non-standard cover plate 704. The general shapes of the parts of this rotary receptacle 701 are shown in exploded view in FIG. 36. The working elements of the rotary receptacle 701 are the body assembly 780 shown in FIG. 37 and the two socket assemblies 740 shown in FIG. 38.

The base assembly 780 is comprised of a metal mounting frame 726, twist lock pins 727 on leaf springs 728, receptacle body 722, hot power bus 713, neutral power bus 721, and ground blade contact 720. The metal frame 726 has two end tabs with the usual plaster ears 734 and mounting openings 736 and a central portion which extends around the ends and bottom of the base 722 providing a secure mounting frame. This central portion has openings 738 for the socket mounting fasteners, mounting openings 732 for the ground blade contact 720 fastener 719, and an appendage 729 with threaded opening 731 for ground wire attachment. The twist lock pins 727 are attached to leaf springs 728 spot welded to the frame and which suspend the pins 727 above the frame and into the socket base 715 recesses 716, thereby preventing rotation to power.

The receptacle base has two generally round cavities 723, but each has two concave depressions 724 in the side walls which act as short ramps in the assembled receptacle. The lower portion of the lateral sides of the base 722 has two openings 725 designed to admit the two power bus 713 ends which are switch receivers 714. The floor of the body has openings to admit the four twist lock springs 728 and pins 727 into the body cavities, two openings 739 to allow the tubular bottom 740 of the socket base 715 (FIG. 36) to rest on the mounting frame when installed, and two openings to allow the fasteners 719 to affix the ground blade contacts 720 and provide electrical communication between the metal mounting frame 726 and the contacts 720.

The power busses 713 and 721 are identical except for the positions of the threaded openings 735 for screw type wire connections to line power. The switch receivers 714 are adapted for horizontal frictional receipt of switch tabs 712 of the socket assemblies 740 when installed.

Figure 38:
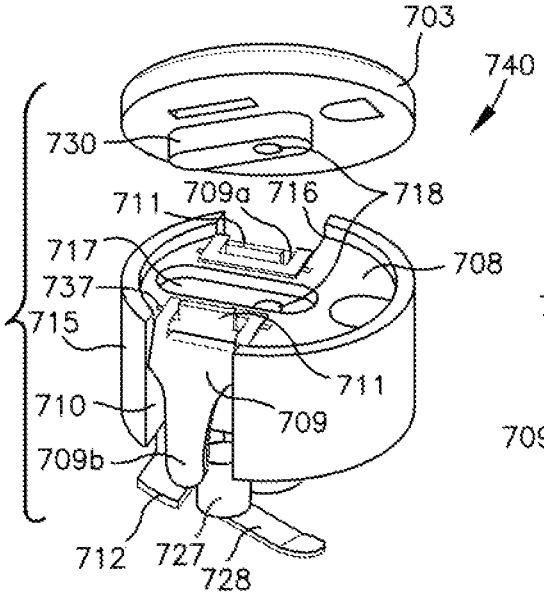
FIG. 38 is a side perspective view of the rotationally switched socket with the cover removed, also showing the rotation lock.

The rotary socket assembly 740 is shown in FIG. 38 along with a twist lock spring 728 and pin 727. The socket 740 is assembled from the socket base 715, two blade contacts 710, two blade lock springs 709 and a top cap 703. The assembled socket 740 is installed in the base assembly 780 with fastener 707, preferably a rivet. The socket base 715 has a larger upper roughly circular portion labeled 715 and a smaller tubular portion 740. The upper portion 715 has two lateral recesses 716 slightly wider than the wide power blade of a polarized plug. Each recess 716 has two narrow lateral vertical slots 737 at its terminus adapted to receive blade contacts 710, which are wider than the recesses 16. The top of the socket base 715 has a round recess 708, an off center deeper oval recess 717, a central passage 718 for the fastener 707 around which the socket assembly 740 pivots, and a shaped recess for the ground tine of a three prong plug.

The blade contacts 710 are installed into the vertical slots 737 in the socket base 715 and may be secured with a friction fit or adhesive. The top part of the blade contact 711 matches the width of the hot blade of a polarized plug, and sticks up as far as the upper rim of the socket base 715.

The blade lock springs 709 have a generally rectangular head with a roughly rectangular opening for plug blades and blade contact tops 711. The springs 709 also have a downward trending tongue 709*a* shown in FIG. 39, and a downward facing tail 709*b* formed laterally in the shape of an arc.

The top cap has the usual slots for the blades of plugs and a central hole 718 for the fastener 707 connecting the socket assembly bottom 740 through the body hole 738 to the metal frame 726 through opening 738. The top cap 703 has an oval shaped protrusion 730 which mates with the socket body recess 717 to keep the socket body 715 and top cap 703 properly aligned. When installed, the top cap 703 rests on the top rim of the socket body 715 forming a void between the 708 recess bottom and the top cap 703, allowing the blade lock spring 709 to rock freely on the blade contact extension 711 as a fulcrum.

The rotation lock pins 727, part of the body assembly, are biased upwards by leaf spring 728 into the bottom portions of the socket base recesses 716, preventing rotation. When a plug is inserted into the socket the blades press the pins 727 below the bottom of the recesses 716 allowing the socket to rotate.

When a socket assembly is installed in the body assembly 780 the tails of the blade lock springs 709*b* are aligned with the concave recesses 724 in the walls surrounding the body cavities 723, and the fastener 707 unites the two assemblies through the metal mounting frame opening 738. Two socket assemblies are required for a standard receptacle, however the principles herein disclosed could be used to configure power receptacles with single or multiple sockets, including extension cord receptacles.

Figure 39:
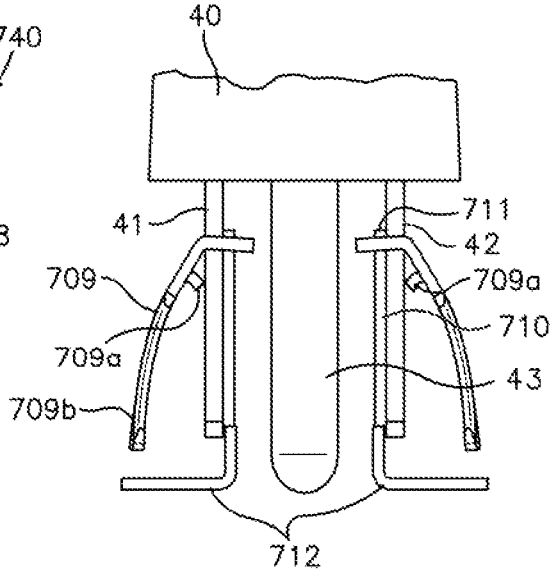
FIG. 39 is a side elevation of the blade locking elements of the rotationally switched receptacle.

FIG. 39 shows the plug locking elements in schematic form for clarity. As stated above, the tails of the plug locking springs are aligned with the concave recesses 724 in the walls of the body. When a plug is inserted into the assembled receptacle, the power blades 41 and 42 first encounter the tongues 709*a*, extending the tails 709*b* into the concave cavities 724. When the blades are fully inserted they press the twist lock pins 727 below the recesses 716 in the socket base 715 allowing the socket to twist to power. At the very beginning of the twist the blade lock tails 709*b* come out of the concave recess 724 putting inward pressure on the tails 709*b*, whereupon the tongues 709*a* clamp the plug blades 41 and 42 to the blade contacts 711 locking the plug into the socket before the twist to power takes place.

Figure 40:
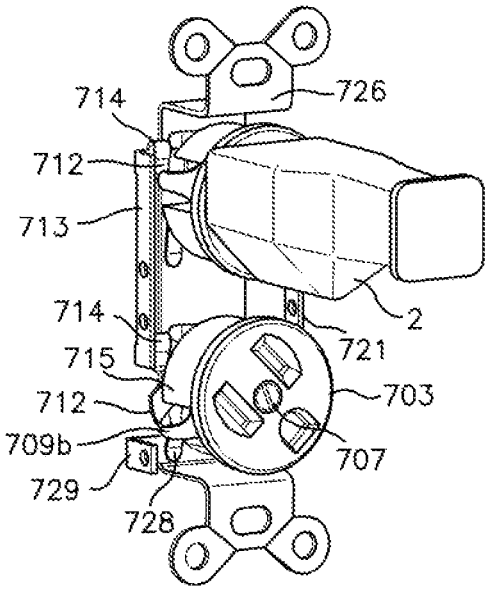
FIG. 40 is a front perspective view of the rotationally switched receptacle of FIGS. 35 and 36 with the body compartment and face plate removed.
Figure 41:
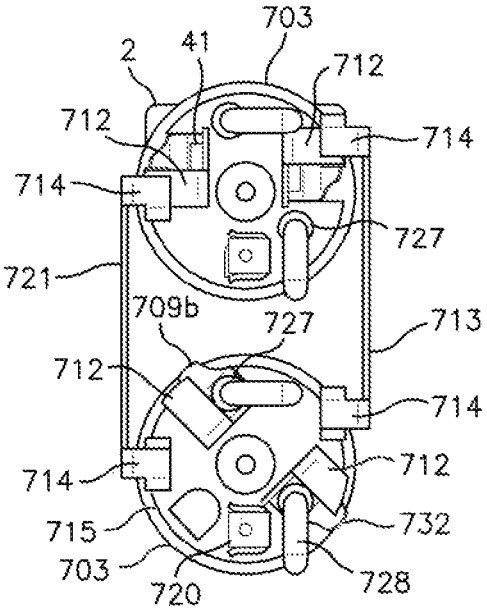
FIG. 41 is a back plan view of FIG. 40 showing the electrical and locking elements.

The relationships of the electrical components and the twist lock are shown in FIGS. 40 and 41. FIG. 40 shows the receptacle 701 with the face plate 704 and body 722 removed, having a powered plug 2 in the top socket and an unpowered lower socket. FIG. 41 is FIG. 40 flipped laterally and with the metal mounting frame 726 removed to reveal the relationships of the electrical and twist locking components. In the lower socket of FIG. 41 there is no electrical communication between the switch tabs 712 of the blade contacts 710, and the twist lock pins 727 are preventing rotation by interference with a side of the socket base recesses 716. When a plug 2 is inserted into this socket the blades press the pins 727 below the recesses 716 allowing rotation. During this rotation the pins 727 are kept depressed by the bottom of the larger socket base portion 715. The rotation places the switch tabs 712 on the blade contacts 710 into the power busses' switch receivers 714, powering the plug 40. When the powered plug is twisted back to the unpowered state the twist lock pins 727 pop back up into the socket base recesses 716, acting as a stop to the counter clockwise rotation and reestablishing the twist lock.

Figure 42:
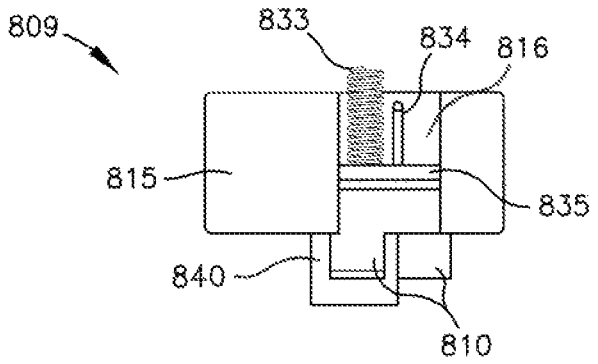
FIG. 42 is a schematic diagram of an alternative embodiment of a blade lock and socket assembly for a rotationally switched receptacle.
Figure 43:
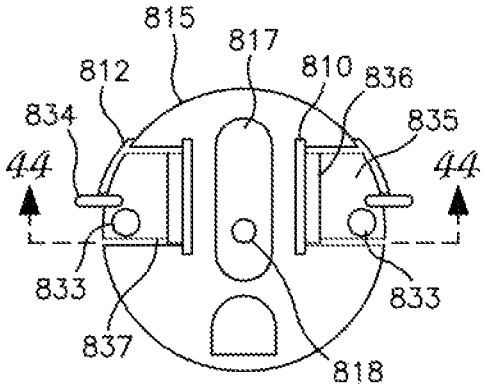
FIG. 43 is a top plan view of the alternative embodiment of the blade lock of FIG. 42.
Figure 44:
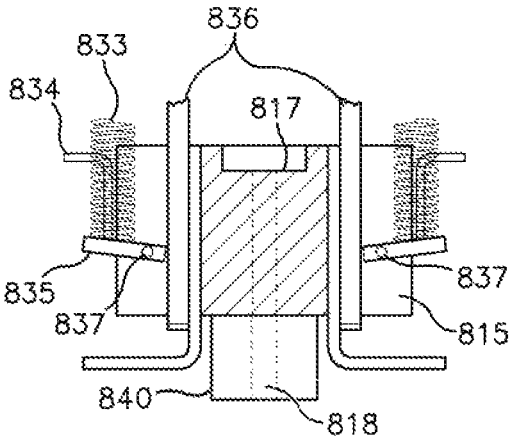
FIG. 44 is a side sectional view of the rotationally switched socket along the line 44-44 of FIG. 43 with plug blades inserted.
Figure 49:
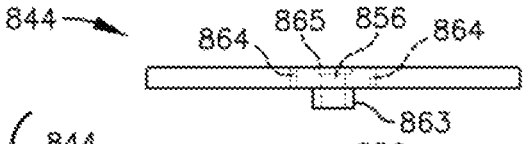
FIG. 49 is a side elevation of the top cap.

It should be obvious from the description of the first five exemplary receptacles that all perturbations of blade locks, movement locks (including significant resistance to movement), and a switch could be used to design workable safety receptacles. Accordingly, a suggested alternative to the rotationally switched receptacle socket assembly 740 is presented in FIGS. 42-44. This alternative rotationally switched receptacle would have a socket base similar to the previous socket base 715 but without the recesses 708. The blade lock would be pivoted locking bars 835 spring 833 biased downward on the proximal edge, but prevented from so moving by the control rod 834 sitting on top of the wall of a body assembly similar to that of 780, but where the wall surrounding the circular cavity 723 had a short ramps downward. A plug is inserted without resistance, but when twisted clockwise the control rods 834 would come down the ramp locking the plug blades with a jamming action to prevent removal. The twist to power would proceed as discussed previously. When twisted counterclockwise the control rod 834 climbs the ramp opening the power blade slots freeing the plug to be removed. The next exemplary receptacle for extension cord uses this type of blade lock system.

An exemplary extension cord receptacle 801 is shown in FIGS. 45-56. The horizontal dimension radially from the blade contacts 860 to the outside walls of each component has been exaggerated to make the figures more readable. The main components of the receptacle are the bottom cap assembly 841, the body assembly 842, the socket assembly 843, and the top cap 844.

Figure 45:
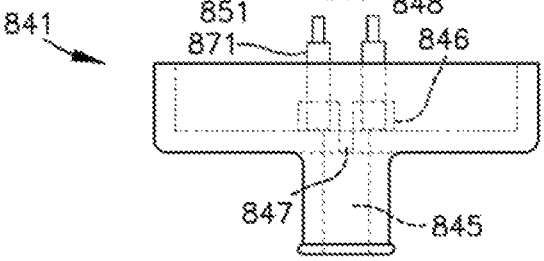
FIG. 45 is a side elevation of the bottom cap assembly of an extension cord receptacle using a rotationally switched socket.
Figure 50:
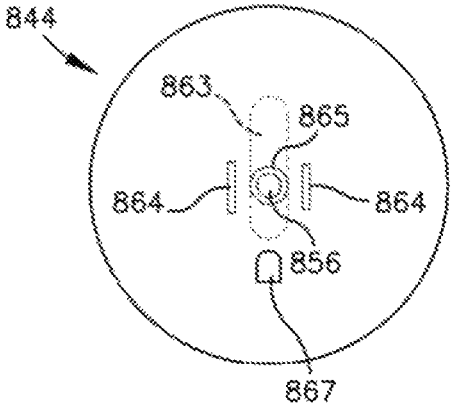
FIG. 50 is a top plan view of the top cap.
Figure 53:
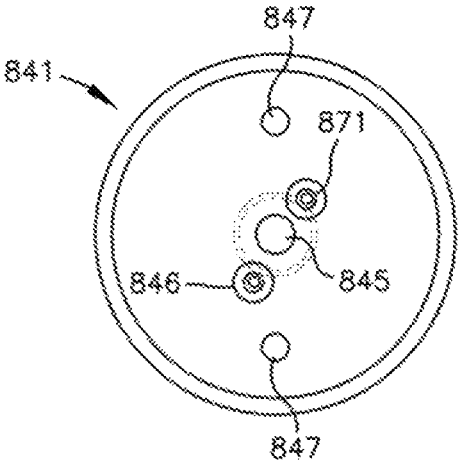
FIG. 53 is a top plan view of the bottom cap.

The bottom cap, shown in side elevation view in FIG. 45 and in top plan view in FIG. 53, has wire inlet opening 845, two tubular projections 846 with plunger type rotation locks 871 (shown in section view in FIG. 54), and two openings 847 for threaded fasteners (not shown) which terminate in the metal frame 848 threaded openings 847*a* of the body assembly 842.

Figure 46:
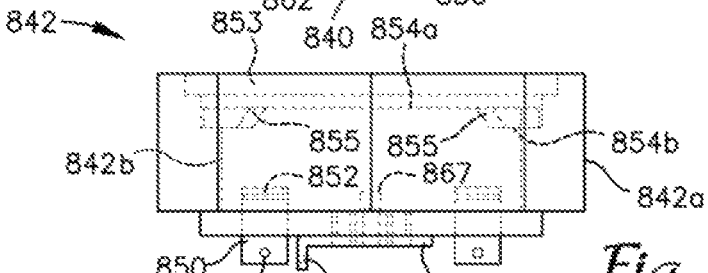
FIG. 46 is a side elevation of the body assembly of the extension cord receptacle.
Figure 54:
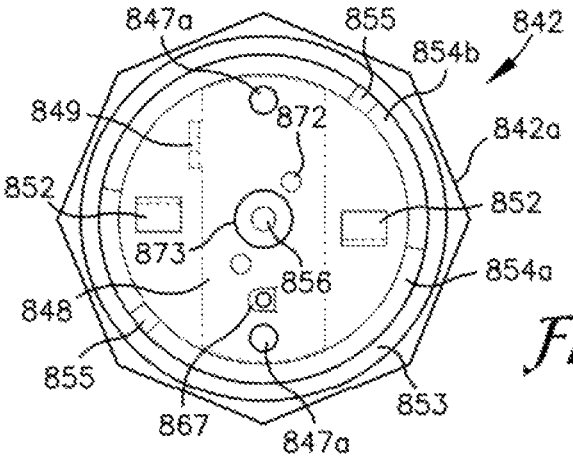
FIG. 54 is a top plan view of FIG. 46, the body assembly of the twist lock extension cord receptacle.
Figure 56:
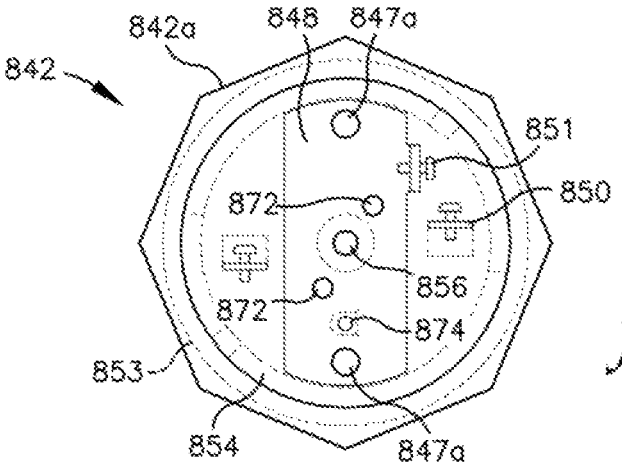
FIG. 56 is a bottom plan view of body of the extension cord receptacle.

The body assembly 842 is shown in side elevation view in FIG. 46, top plan view in FIG. 54, and in bottom plan view in FIG. 56. Since the socket 843 rotates relative to the body 842 it is useful to have a polygon shape for easier grip. A metal frame 848 with ground wire contact 851 attaches to the bottom of the hexagonal base 842*a* by the fastener mounting the inside ground contact 867 to the metal frame 848 through opening 874. Two switch receivers 852 inside the body 842 have tails that pass through slots in the bottom of the body 842 and present power source wire attachment fixtures 850. The top of the body 842*a* steps down to a circular shelf 853 which accommodates the top cap 844. A lower bi-level control shelf 854*a* and 854*b* presents two short ramps between the levels. The lower portion of the body 842*b* is circular to accommodate the socket 843.

Figure 48:
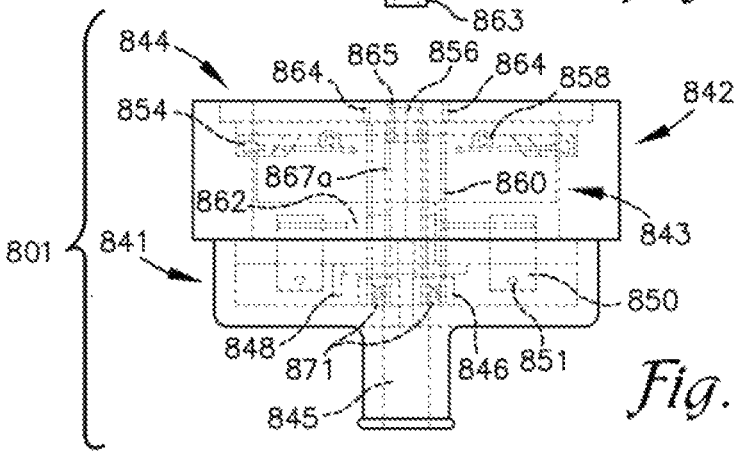
FIG. 48 is a side elevation of the assembled extension cord receptacle components of FIGS. 45-49.
Figure 47:
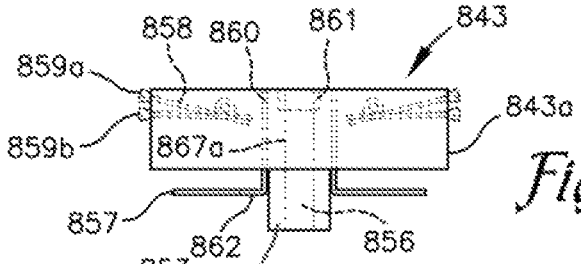
FIG. 47 is a side elevation of the socket assembly of the extension cord receptacle.
Figure 51:
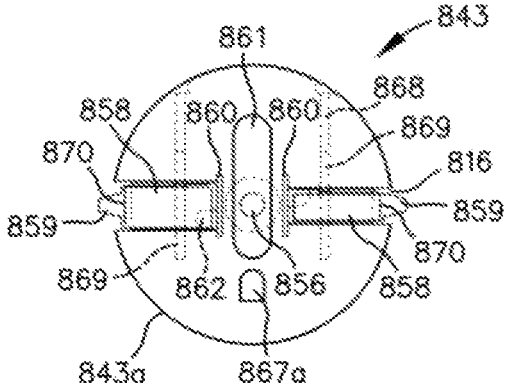
FIG. 51 is a top plan view of the socket assembly.
Figure 55:
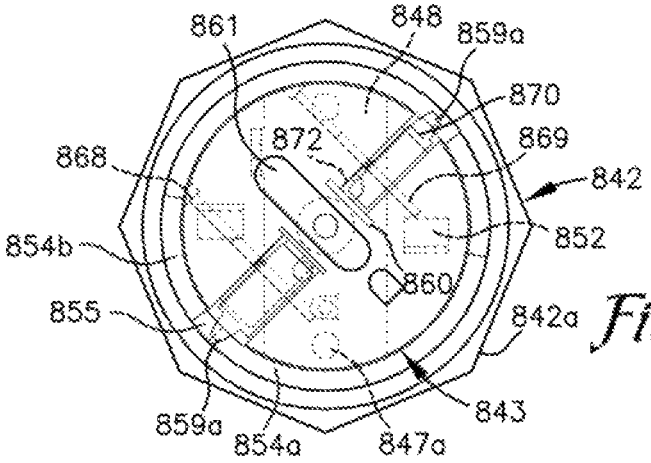
FIG. 55 is a top plan view of the assembled body of FIG. 44 with the twist socket of FIG. 47 installed.

The socket assembly 843 is shown in FIGS. 48 and 51. The socket base 843*a* has the same general shape as that of FIG. 42-44, with oval depression 861 for mating with the top cap 844, recesses 816, the blade contacts 860 with their distal switch tabs 857, the pivot pin 869 in hole 868 for the locking bars 858, torsion springs 870 providing downward bias to the locking bars 858 when the top cap 844 is installed, and a central opening 856 for the fastener which attaches the socket assembly 843 to the base assembly 842. In FIG. 55 the socket assembly 843 is sitting in the base assembly 842 to show the special relationships between the assemblies.

The top cap 844 has the usual power blade slots 864 and ground tine opening 867 for insertion of a plug; a central countersink 865 for a fastener and opening 856 for that fastener and on the underside an oval protrusion 863 designed to mate with the oval depression 861 of the socket assembly 843 to keep them aligned.

Figure 52:
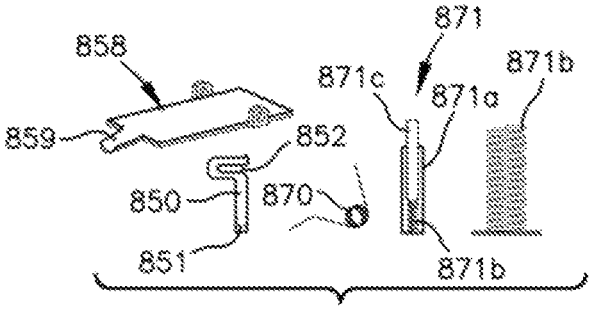
FIG. 52 is a schematic diagram of the small parts used in the twist lock extension cord receptacle.

FIG. 52 shows the detail of the small parts used in the assembled extension cord receptacle shown in FIG. 48, including a section view of the plunger type twist lock 871 and an enlarged view of spring 871*b*, the switch power bus 850 with its switch receiver 852 and threaded opening for wire attachment 851, the torsion spring 870, and blade locking bar 858.

When the receptacle 801 is assembled the twist lock plungers 871 pass through openings 872 in the metal mounting frame 848, pass through cutouts 862 in the lower part of the blade contacts 860, so that the plunger pins 871*c* extend into the recesses 816 in the socket base 815, preventing rotation. The control tabs 859 sit in the raised position 859*a*, opening the power blade slots for easy insertion and removal of a plug as shown in FIG. 55.

When a plug is inserted the blades of a plug 836 contact and push the twist lock plungers 871*c* below the bottom of the recesses 816 and the receptacle socket assembly 843 is rotatable to the powered state. When clockwise rotation starts the control tabs 859 on the locking bars 858 slide down the short ramps 855 in the body assembly 842 urged by the bias of the torsion spring 870, locking the plug into the socket assembly 843. Any attempt to remove the plug in transit or in the powered state causes a jamming effect which tightens the grip of the locking bars 858 on the power blades. At the end of the rotation the blade contact's (860) switch tabs 857 frictionally mate with the switch receivers 852 on the power busses 850 to power the plug, and the ground tine of the plug enters the ground tine contact 867, completing electrical communication between the plug blades and the three power supply wire attachments, two power busses 850 and ground wire connection 851.

When the plug is rotated counter clockwise the electrical connection between the switch tabs 857 and the switch receivers 852 is broken, but the plug remains locked into the socket assembly 843 until the control tabs 859 are raised by the ramps 855 to the upper position 859*a*, freeing the plug to be removed. It should be noted that the control tabs 859 do not ride on the lower surface of the control shelf 854*b* when rotated in either direction. The control tabs 859*b* are suspended above the lower level 854*b* by contact of the locking bars 858 with the power blades of the plug. At the tops of the ramps the cutouts 862 in the blade contacts 860 contact the plunger bodies 871*a*, preventing further counterclockwise rotation, and the plunger pins 871*c* spring back up into the socket recesses 816 reinstating the movement lock.

To defeat this safety receptacle's safety features would require an object in each power slot pressing the plunger pins down and then overcome the resistance provided by the compression of the blade lock spring's tail 709*b*. For children this is extremely unlikely.

The last exemplary tamper resistant receptacle is also shown as an extension cord receptacle. It is generally the same as the previous extension cord receptacle except instead of a control shelf 854 with ramps 855, this receptacle uses lifters shown in FIG. 60 to lift the locking bars 882 at the end of a counterclockwise rotation, allowing a plug to be easily inserted or removed. The lifters 876 are generally triangular with cutouts on one corner forming shelves 890 and top tabs 891. The lifters 876 lie in recesses 878 in the body wall 881*a* and are attached loosely to the wall recesses with appropriate fasteners so that they can rotate between the positions 876*a* and 876*b*. The changes to the body 881 are shown in FIGS. 59, 60 and 62. The socket assembly 843' of this receptacle (shown lying in the socket base 881) is the same as socket assembly 843 shown in FIGS. 47 and 51 except for the control tabs 883 on the locking bars 882 which are flat and narrower as shown in FIG. 61 to fit the lifters' shelves 890.

The top cap 880 of this receptacle differs from the previous top cap 844 only in that it has arcuate protrusions 875 on the underside as shown in FIG. 57-59. The bottom cap 841 of FIGS. 45 and 53 is used unchanged in this extension cord receptacle.

The body 881 is shown in FIG. 59 with the socket assembly sitting it and with a transparent top cap 880 to show the relative positions of the parts. The base 861 has two circular shelves that step down from the body top. The first shelf 853 receives the top cap in assembly. The next shelf 875 is the control shelf 879, although nothing rides on it in operation. As with the previous extension cord receptacle 801 in FIG. 48, during the rotations the locking bars contact plug blades before the control tabs 883 reach the lower shelf 879. In the middle part of the body 881 below the shelves 853 and 879 is the circular cavity 881*a* which surrounds the socket assembly 843'. The remaining parts are the same as body 842 shown in FIGS. 46, 54, and 56.

When the socket assembly 843' is installed in the body 842 (FIG. 59) the control tabs 883 sit on the shelves 890 of the lifters 867*a* in the raised state. The cutouts 862 in the blade contacts 860 align with the body and base openings 872, allowing the twist lock pins 871*c* in the twist lock plungers 871 in the bottom cap 841 upon installation to pass through to interfere with sides of the socket base recesses 816 to prevent rotation. When a plug is inserted, the pins 871*c* are pushed below the socket base recesses 816 wall allowing rotation. The top cap 844 and socket assembly 843 rotate together, so as rotation starts the arcuate protrusion 875 knocks the lifter down to the 876*b* position locking the plug into the socket assembly 843' as with the previous extension cord receptacle, and the rotation terminates with the switch tabs 857 frictionally mating with the switch receivers 852 and the plug ground tine (assuming a three prong plug) enters the ground contact 867, connecting the plug blades to the three wire terminals, two power bus terminals 850 and the ground terminal 851. The arcuate protrusions 875 ride over the lifters 876 to maintain them in the 876*b* position.

The counter clockwise rotation first breaks the connection between the switch tabs 857 and the switch receivers 852, and then when the control tabs 883 on the locking bars 882 reach the lifter's tabs 891 they rotate the lifter to the 876*a* position, raising the control tabs 883 and freeing the plug to be removed.

The embodiments detailed here are not meant to be exclusive. Other embodiments in which different linear movements or rotations may be used to operate a switch. Different types of switches may be used, and since the neutral terminal ordinarily is not dangerous, only the hot side of the power bus might be switched. Other previously described blade locks which use the holes in plug blades or squeezing and jamming the plug blades may be used.

While certain forms of the present invention have been illustrated and described herein with reference to the accompanying drawings, it is to be understood that various changes and modifications will become apparent to those skilled in the art. Such changes and modifications are to be understood as being included within the scope of embodiments of this invention as defined by the appending claims.

What is claimed and desired to be secured by Letters Patent:

1. A safety power receptacle, comprising:

a case having a socket cavity;

a plurality of power buses supported by the case;

a socket supported in movable relation by the case and disposed within the socket cavity for movement between a first position and a second position having blade contacts each providing an electrically conductive blade receptor, the socket has plug blade receivers configured to connect frictionally in an electrically conductive relation with the power buses when the socket is in the second position and disconnect from the power buses the connection when the socket is in the first position, each plug blade receiver comprises an extension having a contact portion configured to engage with one of the power buses, the plug blade receivers each comprise a protrusion positioned to lie in holes within plug blades of an inserted plug, the power buses supported by the case and disposed in electrical communication with the blade contacts of the socket when in the second position;

a socket cover associated with the socket having plug blade guiding slots communicating with the blade contacts of the socket;

a movement lock for the socket, constructed to be unlocked by insertion of a plug into the socket;

a switch comprising the blade contacts of the socket constructed to electrically couple the plug blades in the socket to the power buses when the socket is in the second position and electrically decouple the plug blades of the socket from the power buses when the socket is in the first position; and a plug blade locking mechanism configured to lock the plug blades in the socket when the socket is spaced from the first position.

2. The receptacle of claim 1, wherein the socket is supported to move in a linear path between the first position and the second position.

3. The receptacle of claim 1, wherein a plurality of plug blade locking mechanisms are provided, one for each receiver configured to receive a respective plug blade of a plug.

4. The receptacle of claim 1, wherein the socket cover is affixed in stationary relationship with the case.

5. The receptacle of claim 1, wherein the movement lock comprises a resilient member having ends moveable between a locked position and an unlocked position.

6. The receptacle of claim 1, wherein the socket has plug blade receivers configured to connect frictionally in an electrically conductive relation with the power buses when the socket is in the second position and disconnect from the power buses when the socket is in the first position.

7. The receptacle of claim 6, wherein each plug blade receiver comprises an extension having a contact portion configured to engage with one of the power buses.

8. The receptacle of claim 1, wherein the plug blade locking mechanism comprises an L-shaped flat spring having a proximal end attached to the socket and an opposed free distal end biased to a retracted position sufficient to enable passage of a plug blade by flexed biasing of the distal end of the flat spring away from the respective plug blade receptor when the distal end is urged against an abutment on the socket cover while in the first position and allowing unhindered entrance of the plug blade, but when moved from the first position away from the socket cover and abutment, the distal end of the flat spring unflexes and unbiases to urge the plug blade against the respective plug blade receptor and causes a jamming action to prevent retraction of the plug blade from the receptor and the socket while the socket travels from the first position to the second position.

9. The receptacle of claim 8, wherein, when locked, the flat spring urges the plug blade into electrically conductive relationship with the respective plug blade receiver.

10. A safety power receptacle, comprising:

a case having a socket cavity;

a plurality of power buses supported by the case;

a socket supported in movable relation by the case and disposed within the socket cavity for movement between a first position and a second position having blade contacts each providing an electrically conductive blade receptor, the socket has plug blade receivers configured to connect frictionally in an electrically conductive relation with the power buses when the socket is in the second position and disconnect from the power buses the connection when the socket is in the first position, the plurality of power buses disposed in electrical communication with the blade contacts of the socket when in the second position;

a socket cover associated with the socket having plug blade guiding slots communicating with the blade contacts of the socket;

a movement lock for the socket, constructed to be unlocked by insertion of a plug into the socket, The movement lock comprises at least one locking element movable between a locked position and an unlocked position responsive to blades of a plug being inserted into the socket and further responsive to unlocking of the movement lock by insertion of the plug blades;

a switch comprising the blade contacts of the socket constructed to electrically couple the plug blades in the socket to the power buses when the socket is in the second position and electrically decouple the plug blades of the socket from the power buses when the socket is in the first position; and a plug blade locking mechanism configured to lock the plug blades in the socket when the socket is spaced from the first position.

11. The receptacle of claim 10, further comprising a spring configured to bias the socket in the first position with sufficient resistance to counteract movement of the socket until the plug blades have been completely inserted into the socket in the first position thereby unlocking the movement lock.

12. The receptacle of claim 10, wherein the at least one locking element of the movement lock comprises a resilient member keyed to a width of a received blade of a plug.

13. The receptacle of claim 10, wherein the movement lock comprises a plurality of moveable locking elements spaced-apart about the socket.

14. The receptacle of claim 13, wherein the plurality of locking elements is unlocked simultaneously by insertion of the plug blades from a plug having a standardized configuration of complementary size and shape.

15. The receptacle of claim 13, wherein the plurality of locking elements comprise at least one resilient wire lying beneath the plug blade guiding slots of the socket cover within the socket with at least one end protruding from the socket to lie a respective opening in the case, each wire configured to have a geometric shape configured to flex and retract the respective protruding end into the socket when the plug blades of the plug enter the socket.

16. The receptacle of claim 10, wherein the plug blade locking mechanism is provided in the socket and comprises plug blade receivers having laterally curved surfaces configured to interact with short ramps in a wall of the case to compress the plug blade receivers when the socket is moved from the first position to the second position.

17. The receptacle of claim 16, wherein the angle of the ramp provides a threshold level of resistance to movement of the socket sufficient to unlock the movement locks while the socket is still in the first position.

* * * * *